US012139866B2

(12) United States Patent
Johnston et al.

(10) Patent No.: US 12,139,866 B2
(45) Date of Patent: Nov. 12, 2024

(54) ADAPTER ASSEMBLIES AND METHODS FOR MOUNTING IMPLEMENTS AND ACCESSORIES TO PASSENGER VEHICLES THEREWITH

(71) Applicant: Johnston Landscape Maintenance Inc., Westville, IN (US)

(72) Inventors: Richard Hartley Johnston, Westville, IN (US); David Andrew Sinn, Walkerton, IN (US)

(73) Assignee: Johnston Landscape Maintenance Inc., Westville, IN (US)

( * ) Notice: Subject to any disclaimer, the term of this patent is extended or adjusted under 35 U.S.C. 154(b) by 735 days.

(21) Appl. No.: 17/237,721

(22) Filed: Apr. 22, 2021

(65) Prior Publication Data

US 2021/0332543 A1 Oct. 28, 2021

Related U.S. Application Data

(60) Provisional application No. 63/016,479, filed on Apr. 28, 2020.

(51) Int. Cl.

| | |
|---|---|
| ***E01H 5/06*** | (2006.01) |
| ***E02F 3/627*** | (2006.01) |
| ***E02F 3/76*** | (2006.01) |

(52) U.S. Cl.

CPC ..... *E01H 5/065* (2013.01); *E02F 3/627* (2013.01); *E02F 3/7622* (2013.01)

(58) Field of Classification Search

CPC ..... E01H 5/06; E01H 5/061; E01H 5/065; E01H 5/066; E02F 3/7622; E02F 3/7627; E02F 3/7631; E02F 3/627; A01B 59/048

USPC ..... 37/231; 172/272, 273

See application file for complete search history.

(56) References Cited

U.S. PATENT DOCUMENTS

| | | | | | |
|---|---|---|---|---|---|
| 3,417,886 | A * | 12/1968 | Stuart | E02F 3/3631 | 414/723 |
| 3,760,883 | A * | 9/1973 | Birk | A01B 59/062 | 37/231 |
| 3,887,096 | A * | 6/1975 | Wieland | E02F 3/3672 | 414/723 |
| 4,013,182 | A * | 3/1977 | Pratt et al. | E02F 3/3618 | 414/723 |
| 4,030,624 | A * | 6/1977 | Matthews | E02F 3/3668 | 414/723 |

(Continued)

*Primary Examiner* — Thomas B Will
*Assistant Examiner* — Joel F. Mitchell
(74) *Attorney, Agent, or Firm* — Hartman Global IP Law; Gary M. Hartman; Domenica N. S. Hartman

(57) ABSTRACT

An adapter assembly includes upper and lower crossbars that are horizontally oriented and spaced vertically apart from each other, with each of the upper and lower crossbars having oppositely-disposed outboard ends. A pair of L-shaped brackets and a spacer bracket are mounted adjacent each outboard end of each of the upper and lower crossbars and horizontally orient and space the upper and lower crossbars vertically apart from each other. The pair of L-shaped brackets having lower legs configured to couple with the mount attached to the frame of the vehicle. The adapter assembly is adapted to couple with existing mounts installed on passenger vehicles, such as mounts adapted for the attachment of snow plows, to permit the attachment of a wide variety of implements and accessories to the front ends of such vehicles.

18 Claims, 26 Drawing Sheets

(56) References Cited

U.S. PATENT DOCUMENTS

| | | | | | |
|---|---|---|---|---|---|
| 4,068,959 | A * | 1/1978 | Pemberton | E02F 3/3663 | 403/322.3 |
| 4,243,356 | A * | 1/1981 | Takojima | E02F 3/3672 | 414/723 |
| 4,715,770 | A * | 12/1987 | Kryscyk | A01B 63/108 | 414/920 |
| 4,773,666 | A * | 9/1988 | Koberlein et al. | B62D 49/02 | 172/810 |
| 5,010,962 | A * | 4/1991 | Bloom, Jr. | E02F 9/26 | 37/906 |
| 5,419,673 | A * | 5/1995 | Merhar | E02F 3/3672 | 37/468 |
| 5,692,855 | A * | 12/1997 | Burton | E02F 3/3668 | 37/906 |
| 8,117,773 | B2 * | 2/2012 | Seda et al. | E02F 3/3631 | 37/468 |
| 8,689,898 | B2 * | 4/2014 | Benesch | E02F 3/422 | 37/231 |
| 8,777,546 | B2 * | 7/2014 | Lanting et al. | E02F 3/3414 | 37/468 |

* cited by examiner

Section A-A

Section C-C

ADAPTER ASSEMBLIES AND METHODS FOR MOUNTING IMPLEMENTS AND ACCESSORIES TO PASSENGER VEHICLES THEREWITH

CROSS REFERENCE TO RELATED APPLICATIONS

This application claims the benefit of U.S. Provisional Application No. 63/016,479, filed Apr. 28, 2020, the contents of which are incorporated herein by reference.

BACKGROUND OF THE INVENTION

The present invention generally relates to passenger vehicles and to the attachment of various types of implements and accessories to the front ends of such vehicles. The invention particularly relates to adapter assemblies adapted to couple with existing mounts installed on passenger vehicles, such as mounts adapted for the attachment of snow plows, to permit the attachment of a wide variety of implements and accessories to the front ends of such vehicles.

Snow plows are commercially available that can be mounted to the front ends of various types of passenger vehicles, including but not limited to pickup trucks, all-terrain vehicles (ATVs), and utility vehicles (UTVs), including on-road and off-road variations of each. Snow plows are typically mounted to the vehicle frame with specially adapted attachment systems so that they can be quickly removed from the vehicle. Various types of snow plows and their attachment systems are commercially available, notable examples of which are Boss snow plows from Boss Products of Iron Mountain, Michigan USA, and Western snow plows from Western Products of Milwaukee, Wisconsin USA. Other well-known brands include Fisher, Snow Ex and Curtis.

Attachment systems for mounting snow plows to the front ends of vehicles typically include a mount that is secured to the vehicle frame and intended to remain on the vehicle when the snow plow is removed. Regardless of whether the snow plow is to be mounted to a pickup truck, ATV, or UTV, the mounts for attachment systems offered by Western are typically in the form of a pair of inverted C-channels that are directly secured to the vehicle frame, and the mounts for attachment systems offered by Boss utilize a pair of vertically-oriented C-shaped brackets that are directly secured to the vehicle frame. The usefulness of these mounts is limited to coupling with their particular attachment systems for mounting specific brands of snow plows.

In view of the above, it can be appreciated that there are certain problems, shortcomings or disadvantages associated with the prior art, and that it would be desirable if improved systems and/or methods were available for coupling implements and accessories to existing mounts installed on passenger vehicles.

BRIEF DESCRIPTION OF THE INVENTION

The present invention provides adapter assemblies and methods of coupling said adapter assemblies with existing mounts installed on passenger vehicles, such as mounts adapted for the attachment of snow plows, to permit the attachment of a wide variety of implements and accessories to the front ends of such vehicles.

According to one aspect of the invention, an adapter assembly includes upper and lower crossbars that are horizontally oriented and spaced vertically apart from each other, with each of the upper and lower crossbars having oppositely-disposed outboard ends. A pair of L-shaped brackets and a spacer bracket are mounted adjacent each outboard end of each of the upper and lower crossbars and horizontally orient and space the upper and lower crossbars vertically apart from each other. The pair of L-shaped brackets having lower legs configured to couple with the mount attached to the frame of the vehicle.

According to other aspects of the invention, the adapter assembly further comprises an attachment hook adapted to be releasable coupled to the adapter assembly.

According to further aspects of the invention, implements and accessories can be directly coupled to the adapter assembly or to an attachment hook releasable coupled to the adapter assembly.

According to another aspect of the invention, a method is provided for mounting an implement or accessory to a front end of a vehicle that has a mount attached to a frame of the vehicle. The method includes providing an adapter assembly that includes upper and lower crossbars that are horizontally oriented and spaced vertically apart from each other, each of the upper and lower crossbars having oppositely-disposed outboard ends, and a pair of L-shaped brackets and a spacer bracket mounted adjacent each outboard end of each of the upper and lower crossbars and horizontally orienting and spacing the upper and lower crossbars vertically apart from each other. The method includes coupling lower legs of the pair of L-shaped brackets to the mount attached to the frame of the vehicle, and attaching an implement or accessory to the adapter assembly.

Technical effects of adapter assemblies having the features described above and the method of use thereof include the ability to be quickly coupled and decoupled with existing mounts, including but not limited to snow plow mounts, on the front end of a passenger vehicle to permit the attachment of a wide variety of implements and accessories to the vehicle.

Other aspects and advantages of this invention will be appreciated from the following detailed description.

DETAILED DESCRIPTION OF THE INVENTION

Figures 1A, 1B:
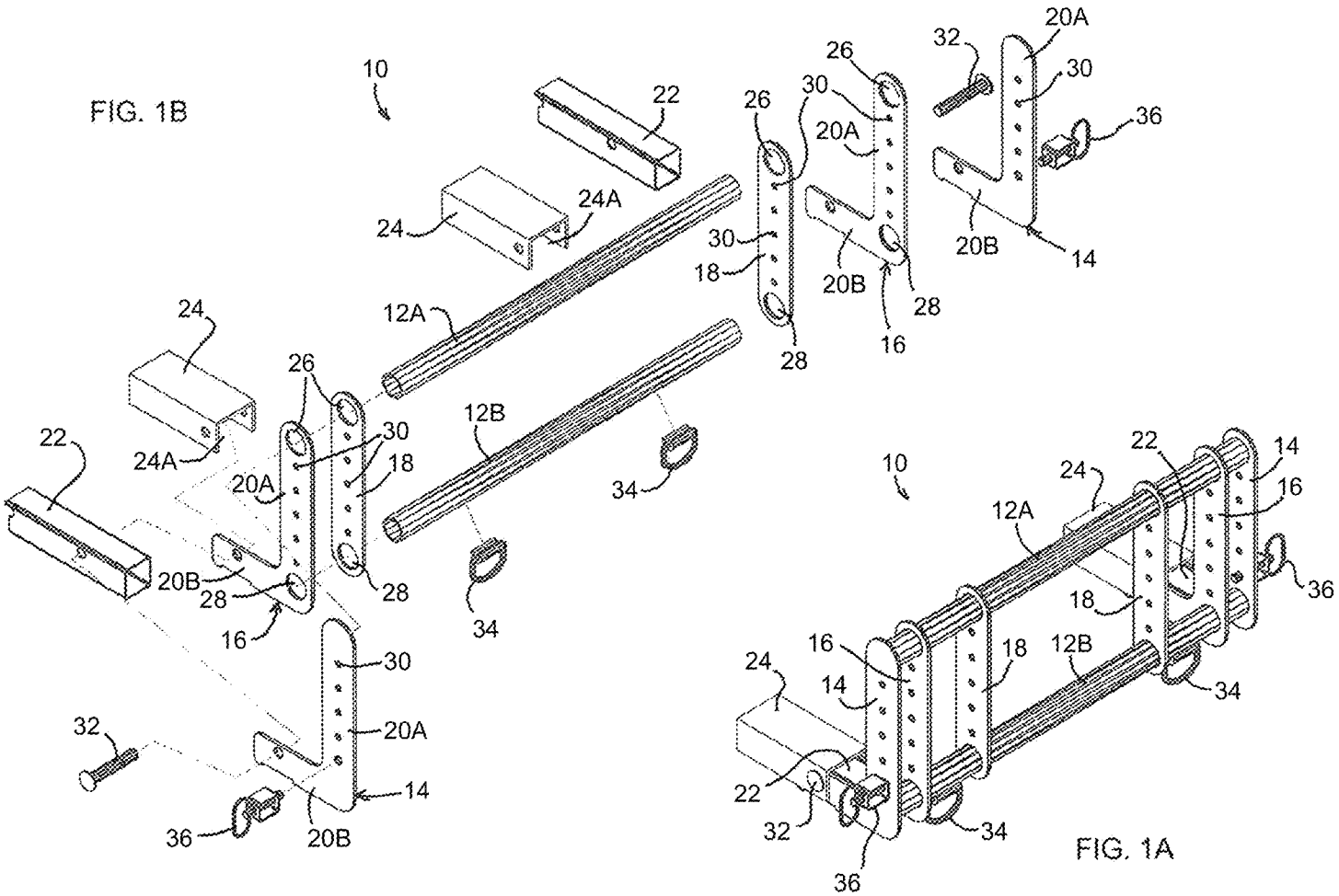
FIGS. 1A and 1B represent an adapter assembly and an exploded view of the adapter assembly in accordance with a first nonlimiting embodiment of this invention.

FIGS. 1A and 1B and FIGS. 2A and 2B represent perspective assembly and exploded views of two adapter assemblies 10 and 110 in accordance with nonlimiting embodiments of the invention. To facilitate the description provided below of the embodiments represented in the drawings, relative terms, including but not limited to, "vertical," "horizontal," "lateral," "front," "rear," "side," "forward," "rearward," "upper," "lower," "above," "below," "right," "left," "inboard," "outboard," etc., may be used in reference to the orientation of each adapter assembly 10 and 110 when installed for use on a vehicle as represented in the drawings, and therefore are relative terms that indicate the construction, installation and use of the invention and therefore help to define the scope of the invention.

The adapter assembly 10 of FIGS. 1A and 1B is represented as comprising a pair of vertically-spaced crossbars 12A and 12B maintained in vertical alignment with respect to each other by vertical legs 20A of two pairs of L-shaped brackets 14 and 16 and a pair of spacer brackets 18. As shown, the crossbars 12A and 12B are horizontal and parallel to each other, though other orientations are possible. Each L-shaped bracket 14 is adjacently paired with an L-shaped bracket 16 at oppositely-disposed outboard ends of the crossbars 12A and 12B, with the L-brackets 14 being most outboard on the assembly 10. Each spacer bracket 18 is located inboard of an adjacent pair of the L-shaped brackets 14 and 16. Each of the L-shaped bracket 16 and spacer brackets 18 has upper and lower holes 26 and 28 through which, respectively, the upper and lower crossbars 12A and 12B are received. Additionally, the vertical legs 20A of each L-shaped bracket 14 and 16 and the vertical extent of each spacer bracket 18 has an array of holes 30 to provide locations for attachment. Installed in one aligned pair of these holes 30 are spring-loaded lock pins 36 for securing an attachment hook 40, which is shown and will be described in reference to FIGS. 3A through 3F. Optional rings 34 are shown as mounted to the lower crossbar 12B to provide additional locations for mounting accessories. Lower horizontal legs 20B of adjacent pairs of the L-shaped brackets 14 and 16 are secured together with a mounting bar 22 therebetween, creating a subassembly of the brackets 14 and 16 having joined lower horizontal legs 20B that define a lower leg unit that is sized to be received and secured within a channel 24A defined by a mount 24 (in this case, a C-channel), for example, with a bolt 32. In preferred but nonlimiting embodiments of the invention, the mount 24 is of a type for mounting a snow plow, for example, a Western brand snow plow. In this manner, the adapter assembly 10 can be easily and quickly installed on and removed from the mount 24 with the bolts 32.

Figures 2A, 2B:
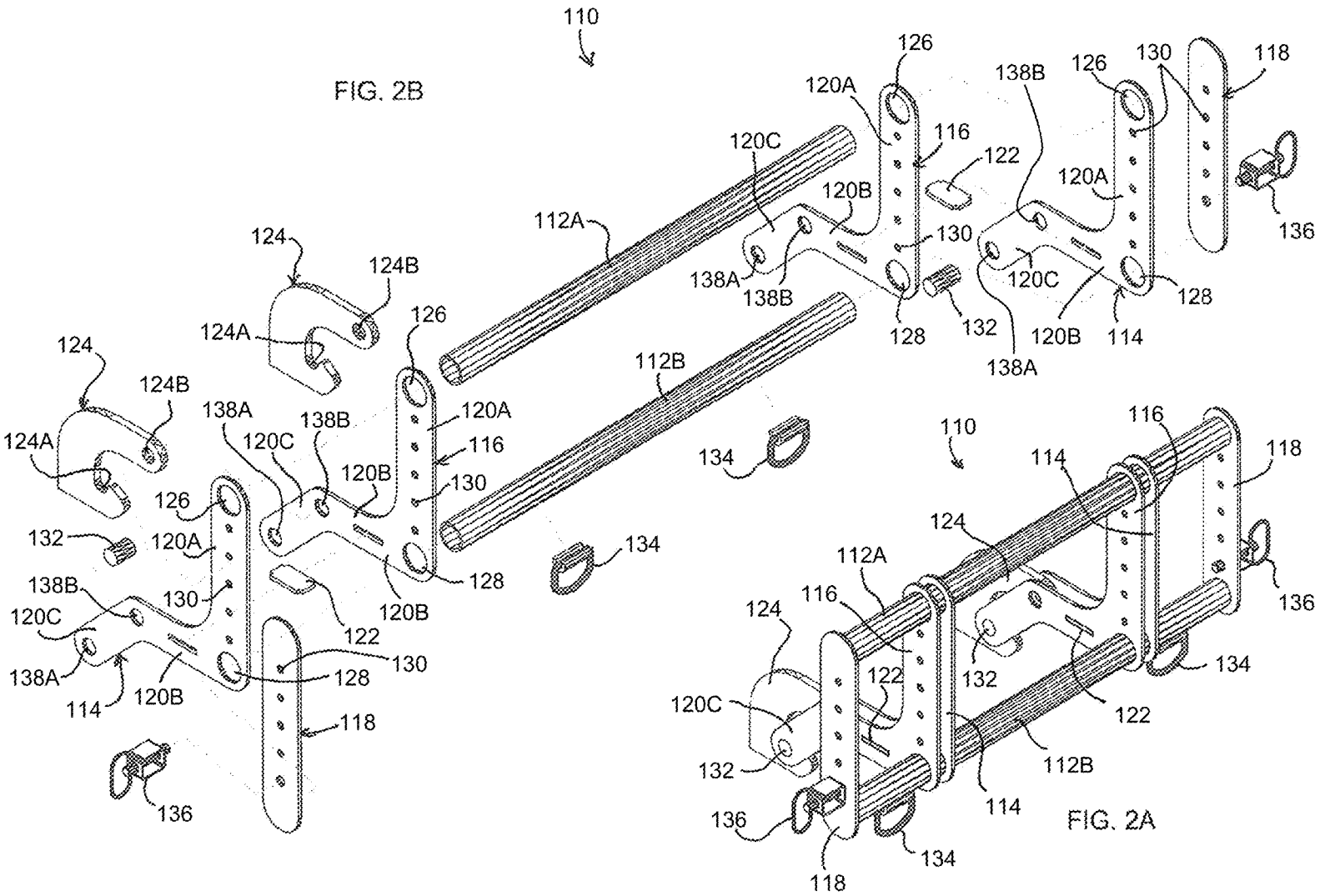
FIGS. 2A and 2B represent an adapter assembly and an exploded view of the adapter assembly in accordance with a second nonlimiting embodiment of this invention.

The adapter assembly 110 of FIGS. 2A and 2B is similarly configured to the assembly 10 of FIGS. 1A and 1B. Differences between the assemblies 10 and 110 are attributable to being configured for attachment to a different style of mount, which in the case of the assembly 110 is a mount 124 comprising a vertically-oriented C-shaped bracket such as of a type for mounting a snow plow, for example, a Boss brand snow plow. In view of these similarities, consistent reference numbers are used to identify the same or functionally related/equivalent elements, but with a numerical prefix (1) added to distinguish the embodiment FIGS. 2A and 2B from the embodiment of FIGS. 1A and 1B. Furthermore, the following discussion of FIGS. 2A and 2B will focus primarily on aspects of the second embodiment that differ from the first embodiment of FIGS. 1A and 1B in some notable or significant manner. Other aspects of the second embodiment not discussed in any detail can be, in terms of structure, function, materials, etc., essentially as was described for the first embodiment.

The adapter assembly 110 of FIGS. 2A and 2B is represented as comprising a pair of vertically-spaced crossbars 112A and 112B maintained in vertical alignment with respect to each other by vertical legs 120A of two pairs of L-shaped brackets 114 and 116 and a pair of spacer brackets 118. Each L-shaped bracket 114 is adjacently paired with an L-shaped bracket 116 at oppositely-disposed outboard ends of the crossbars 112A and 112B, with the L-brackets 114 being most outboard of each pair. In contrast to the assembly 10 of FIGS. 1A and 1B, because of the different style of mount 124, each spacer bracket 118 may be located on the assembly 110 outboard of an adjacent pair of the L-shaped brackets 114 and 116. Consequently, each of the L-shaped brackets 114 and 116 has upper and lower holes 126 and 128 through which, respectively, the upper and lower crossbars 112A and 112B are received, whereas the spacer brackets 118 are not required to have holes for receiving the crossbars 112A and 112B. The vertical legs 120A of each L-shaped bracket 114 and 116 and the vertical extent of each spacer bracket 118 has an array of holes 130 to provide locations for attachment. Installed in one aligned pair of these holes 130 are spring-loaded lock pins 136 for securing an attachment hook 140, which is shown and will be described in reference to FIGS. 4A through 4F. Optional rings 134 are shown as mounted to the lower crossbar 112B to provide additional locations for mounting accessories. Lower horizontal legs 120B of adjacent pairs of the L-shaped brackets 114 and 116 are secured together with a mounting bar 122 therebetween, creating a subassembly of the brackets 114 and 116, which are each further configured to have lower angular (neither vertical nor horizontal) legs 120C that, as a result of the lower horizontal legs 120B being joined, define a lower leg unit that is sized to be coupled to the mount 124. Due to the different orientation and configuration of the C-shaped bracket of the mount 124, each lower leg unit defined by the angular legs 120C of a pair of brackets 114 and 116 is coupled to its corresponding mount 124 with at least one pin 132 that is fixed within a complementary pair of holes 138A at a lower extremity of the angular legs 120C, and is sized to be received in a cradle 124A formed by its corresponding mount 124. Additionally, each lower leg unit defined by each pair of angular legs 120C is coupled to its mount 124 with at least one pin, bolt, or other suitable structure (not shown) that is sized to be received in a complementary pair of holes 138B at an upper extremity of the angular legs 120C and a hole 124B formed in its corresponding mount 124. In this manner, the adapter assembly 110 can be easily and quickly installed on and removed from the mount 124 with the pins (or other structure) received in the holes 138B of the mount 124.

FIGS. 3A through 3F represent the assembly 10 of FIGS. 1A and 1B in combination with the aforementioned attachment hook 40, and FIGS. 4A through 4F represent the assembly 110 of FIGS. 2A and 2B in combination with the aforementioned attachment hook 140. In addition, FIGS. 21 through 24 represent additional nonlimiting embodiments of attachment hooks 240 and 340. As apparent from the drawings, the attachment hooks 40, 140, 240, and 340 can be similarly configured if not identical, and/or may function in a substantially similar manner or for a substantially similar purpose. As such, the attachment hook 40 will be described, with the understanding that the description also applies to the attachment hooks 140, 240, and 340, and that consistent reference numbers are used to identify the same or functionally related/equivalent elements of the hooks 40, 140, 240, and 340, but with a numerical prefix (1, 2, or 3) added to reference numbers used in respect to the hooks 140, 240, and 340 to distinguish the components of the hooks 140, 240, and 340 from the components of the hook 40.

The attachment hook 40 is represented as comprising a pair of vertically-spaced crossbars 42A and 42B maintained in vertical alignment with respect to each other by a pair of vertical brackets 44. Each bracket 44 has an upper hook feature 46 located at or near its uppermost extent, and a lower hook feature 48 located at or near its lowermost extent. Both upper and lower hook features 46 and 48 are C-shaped, but the upper hook feature 46 defines an opening facing downward whereas the lower hook feature 48 defines an opening facing horizontally. With this arrangement, the attachment hook 40 can be assembled with the adapter assembly 10 by engaging the upper crossbar 12A with the upper hook feature 46, and then pivoting the attachment hook 40 downward toward the adapter assembly 10 to engage the lower crossbar 12B with the lower hook feature 48, as evident from FIGS. 3A through 3D. Each bracket 44 comprises a boss 50 with a hole that can be engaged with a corresponding one of the spring-loaded lock pins 36 to secure the attachment hook 40 to the adapter assembly 10. In this manner, the attachment hook 40 can be easily and quickly installed on and removed from the adapter assembly 10.

As previously noted and shown, the L-shaped brackets 14 and 16 are located outboard of the spacer bracket 18 in the adapter assembly 10, whereas the L-shaped brackets 114 and 116 are located inboard of the spacer bracket 118 of the adapter assembly 110. Due to the intended universality of the attachment hooks 40 and 140, the vertical brackets 44 of the attachment hook 40 and their upper and lower hook features 46 and 48 are shown to engage the crossbars 12A and 12B adjacent the L-shaped brackets 14 at the outboard ends of the assembly 10, and the vertical brackets 144 of the attachment hook 140 and their upper and lower hook features 146 and 148 are shown to engage the crossbars 112A and 112B adjacent the spacer brackets 118 at the outboard ends of the assembly 110.

Figure 3A:
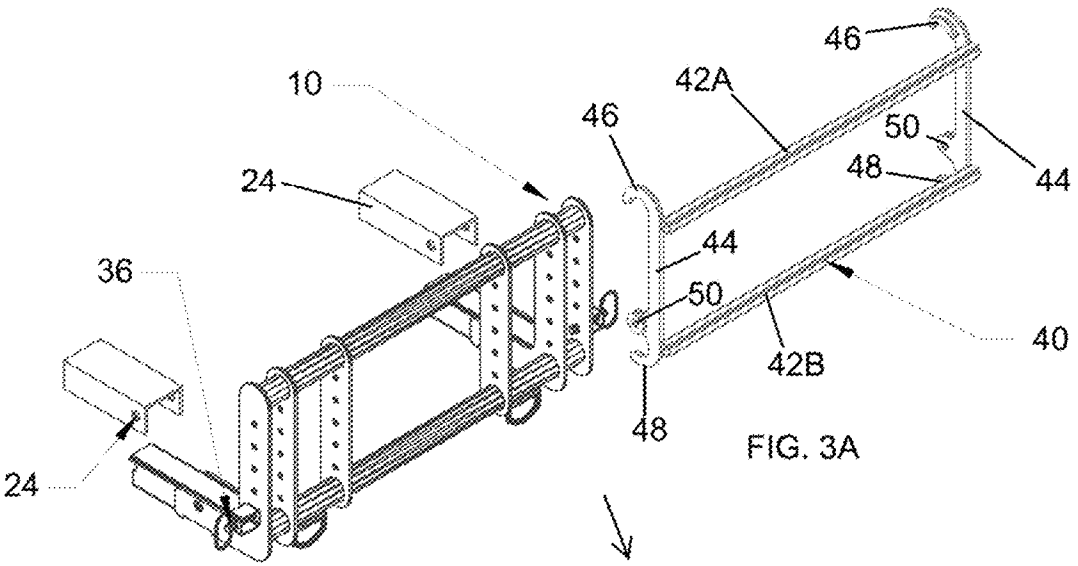
FIGS. 3A through 3D represent various views of the adapter assembly of FIG. 1A and a universal attachment for use with the adapter assembly in accordance with the first nonlimiting embodiment of this invention.
Figure 3B:
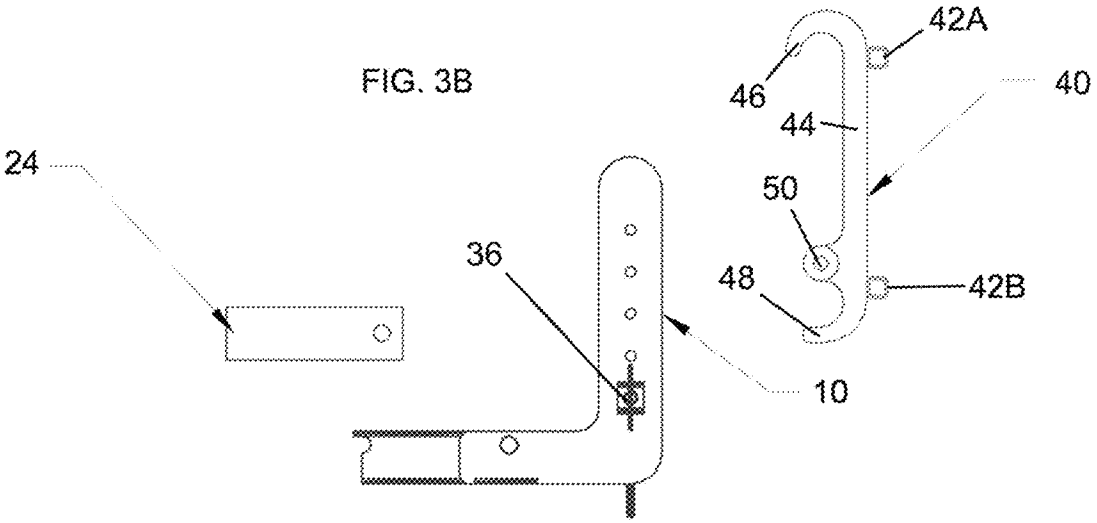
Figure 3C:
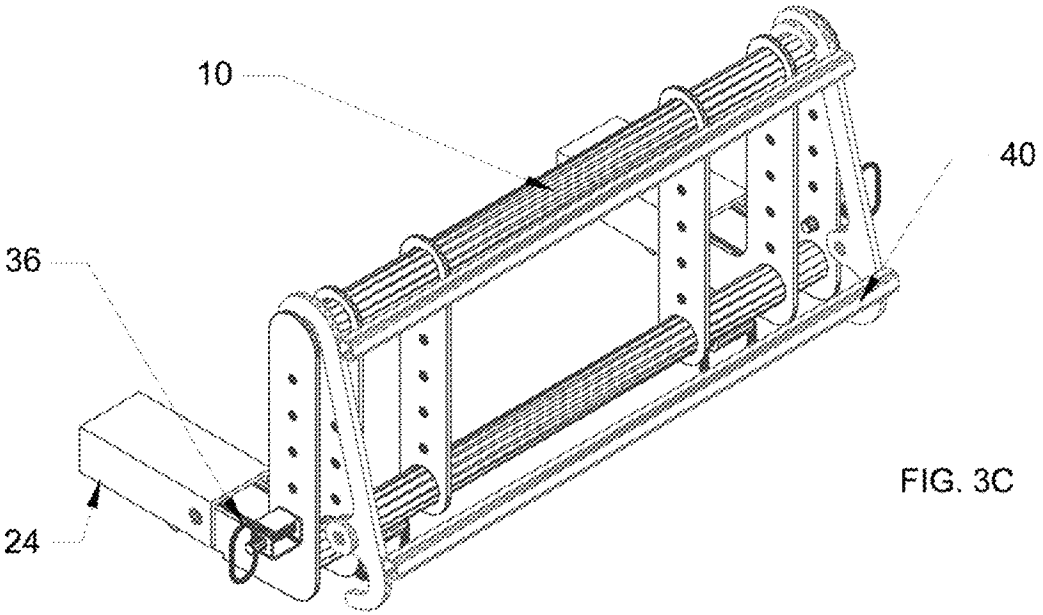
Figure 3D:
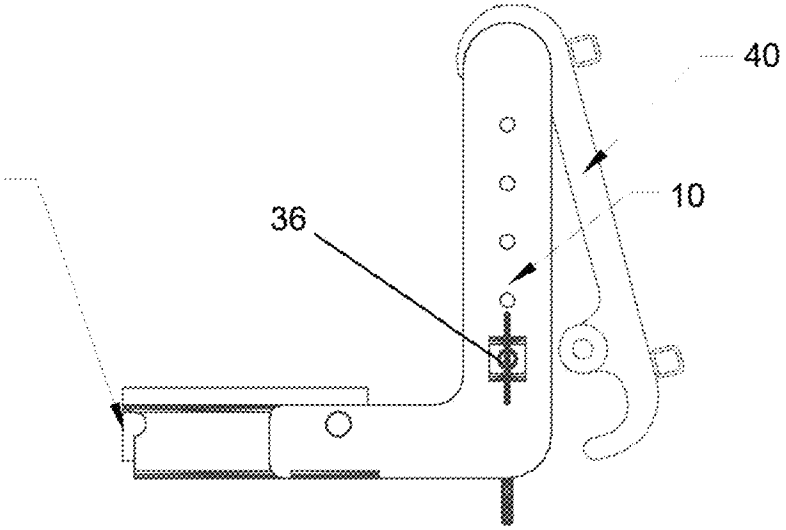
Figure 3E:
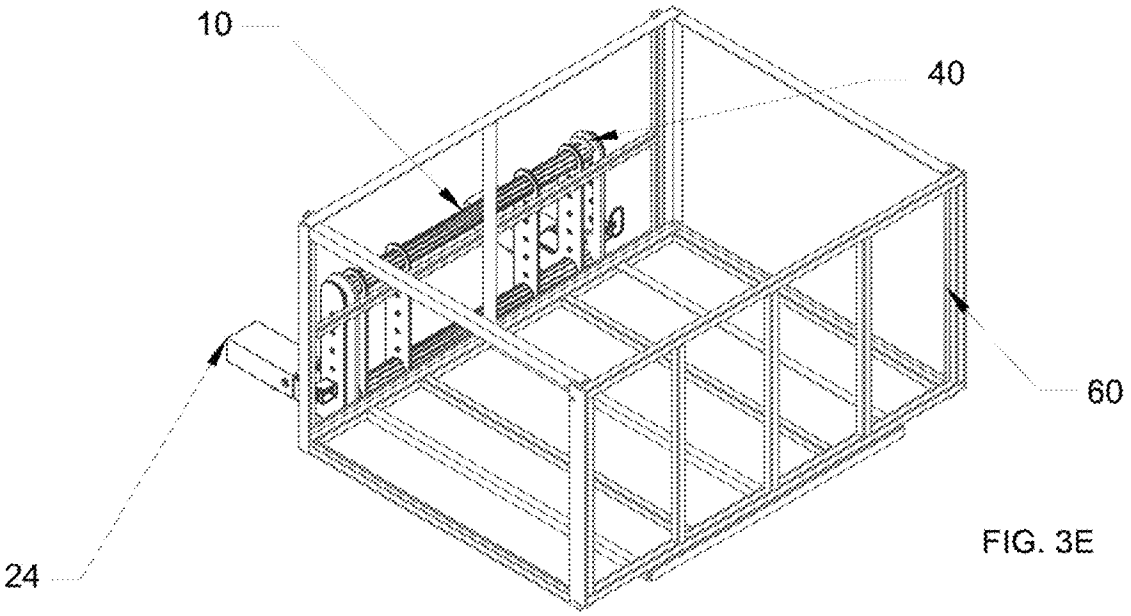
FIGS. 3E and 3F represent views of the adapter assembly of FIGS. 1A and 3A through 3D coupled to an accessory in accordance with a nonlimiting embodiment of this invention.
Figure 3F:
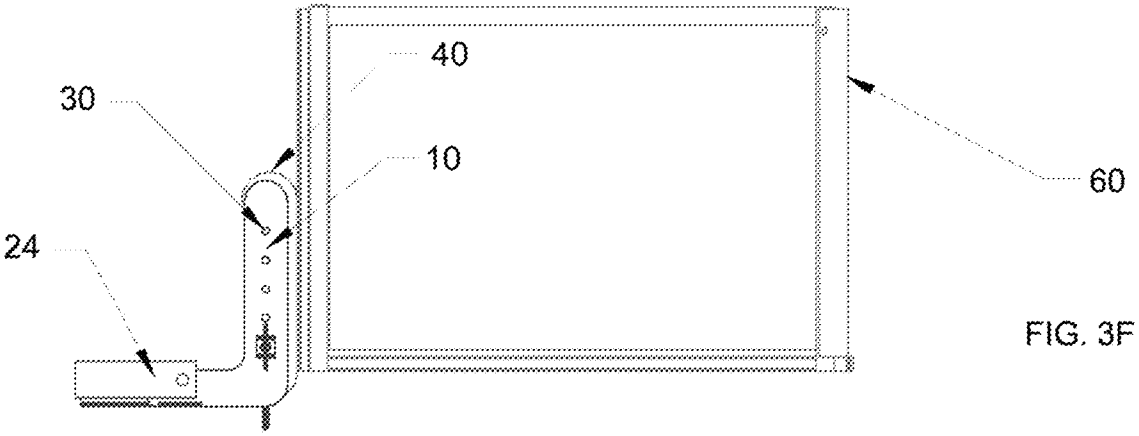
Figure 4A:
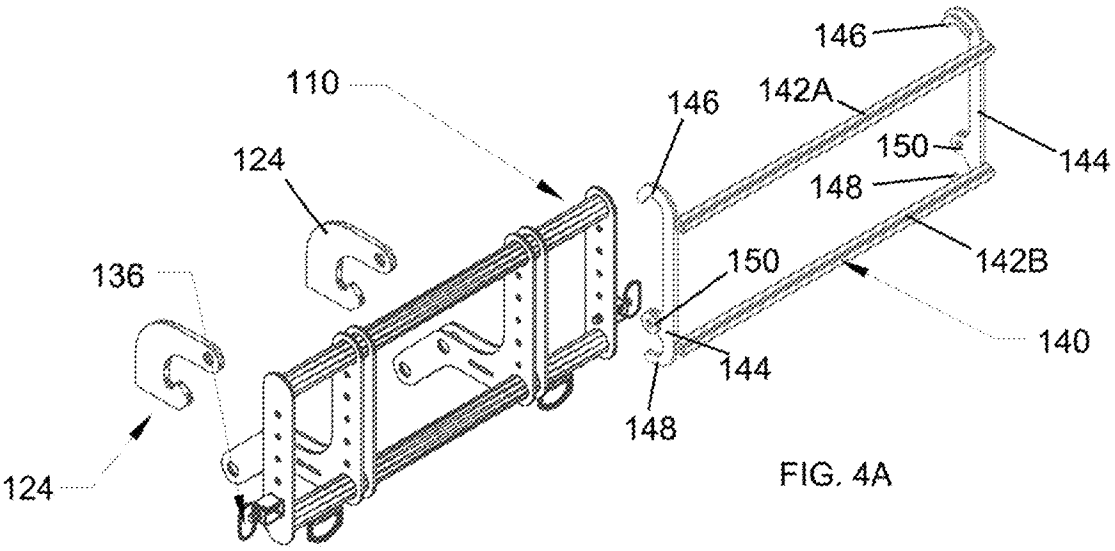
FIGS. 4A through 4D represent various views of the adapter assembly of FIG. 2A and a universal attachment for use with the adapter assembly in accordance with the first nonlimiting embodiment of this invention.
Figure 4B:
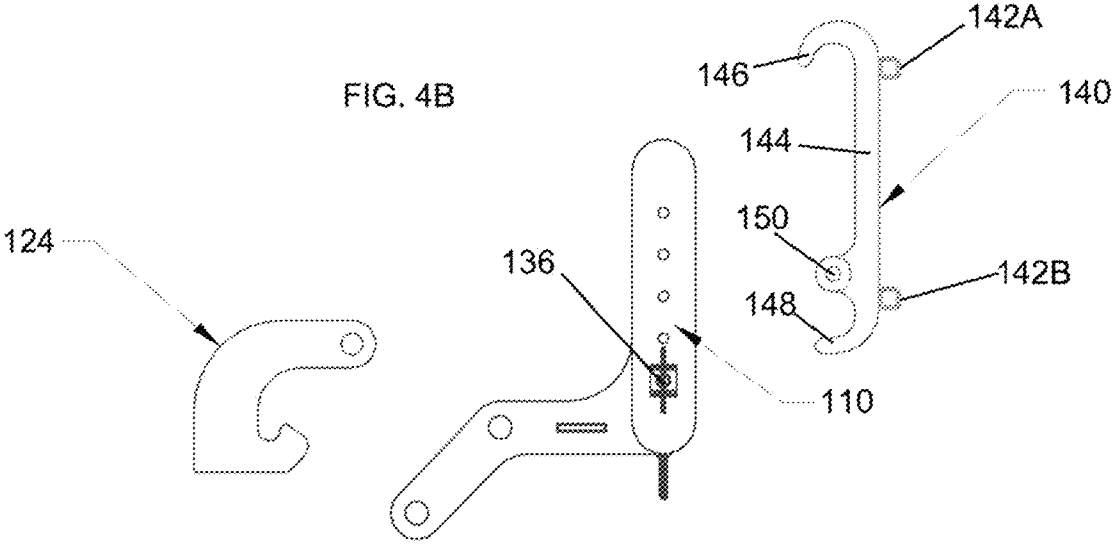
Figure 4C:
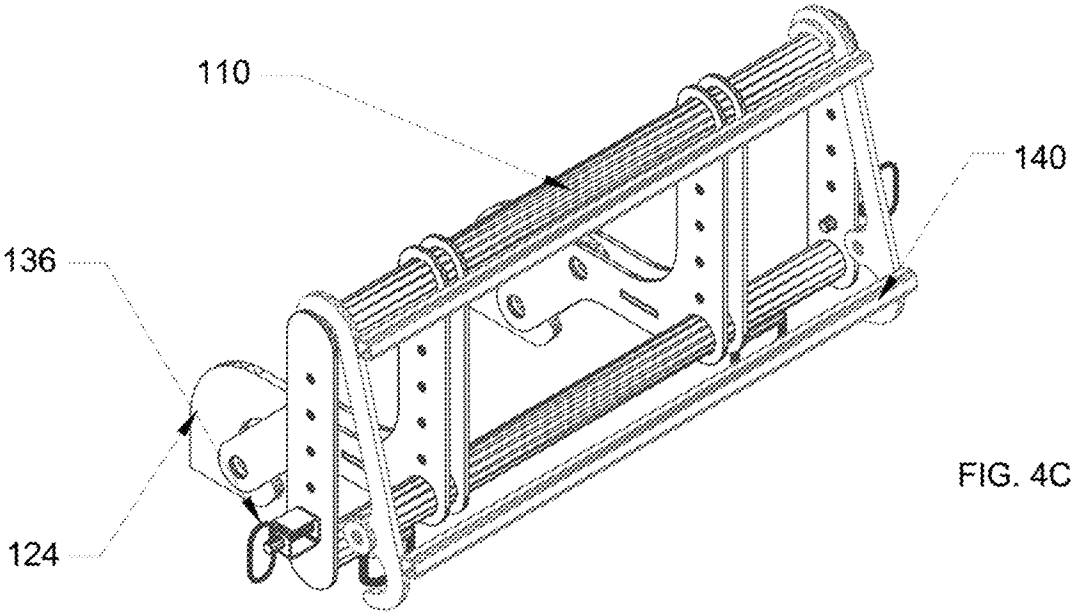
Figure 4D:
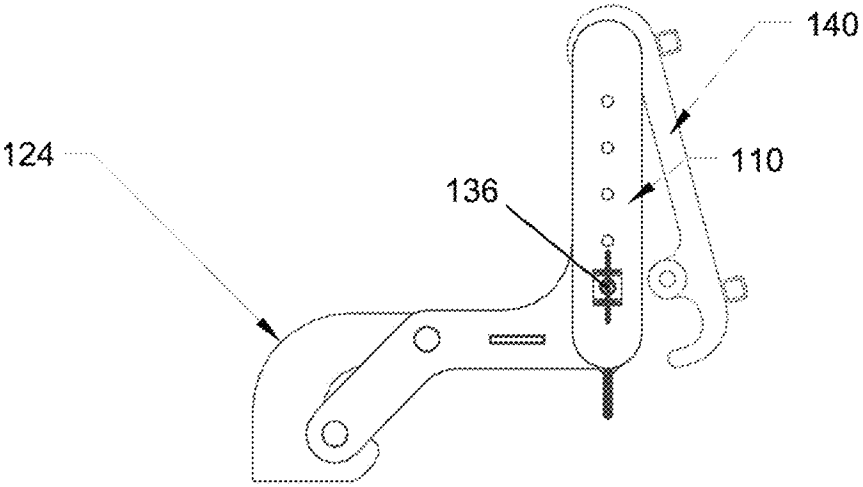
Figure 4E:
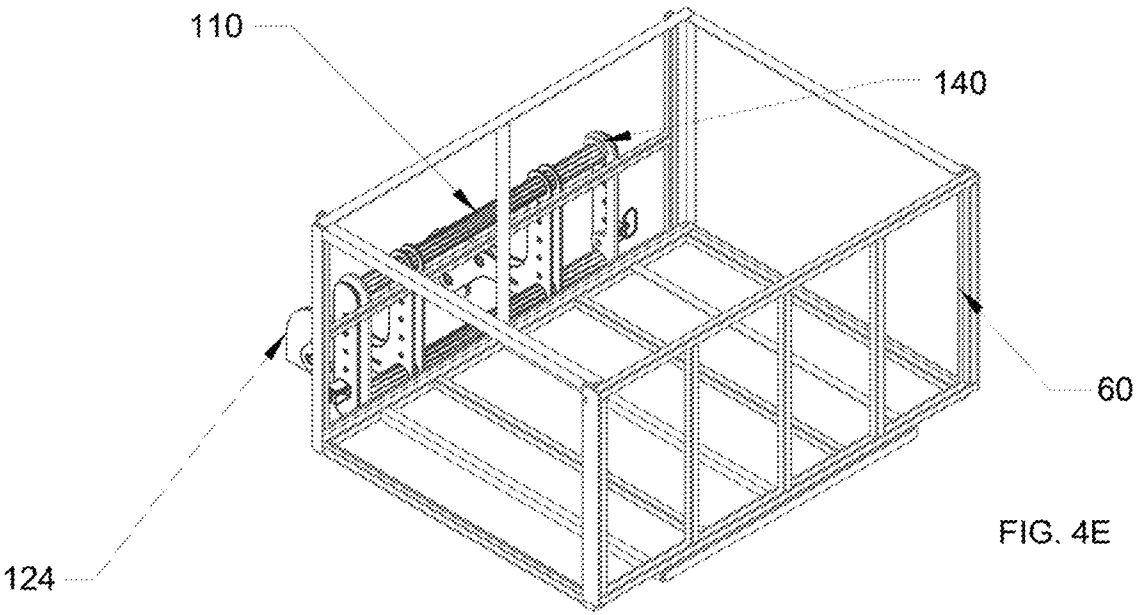
FIGS. 4E and 4F represent views of the adapter assembly of FIGS. 2A and 4A through 4D coupled to an accessory in accordance with a nonlimiting embodiment of this invention.
Figure 4F:
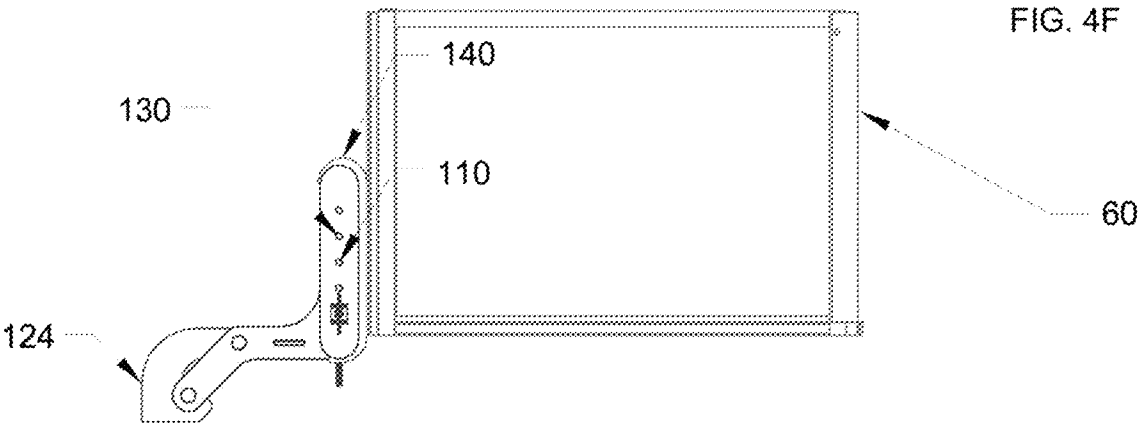

As shown in FIGS. 3E and 3F, the attachment hook 40 can be permanently (or removably) attached to an accessory 60, so that the accessory 60 and its attachment hook 40 can be easily and quickly installed on and removed from the adapter assembly 10 as a unit, and therefore also as a unit to and from a vehicle to which the mount 24 is secured.

As previously noted, the preceding discussion of FIGS. 3A through 3F is equally applicable to the adapter assembly 110 and its attachment hook 140 of FIGS. 2A, 2B, and 4A through 4F. Similarly, although not shown, the attachment hooks 240 and 340 of FIGS. 21 through 24 may engage adapter assemblies similar or identical to the adapter assemblies 10 and 110.

Figure 21:
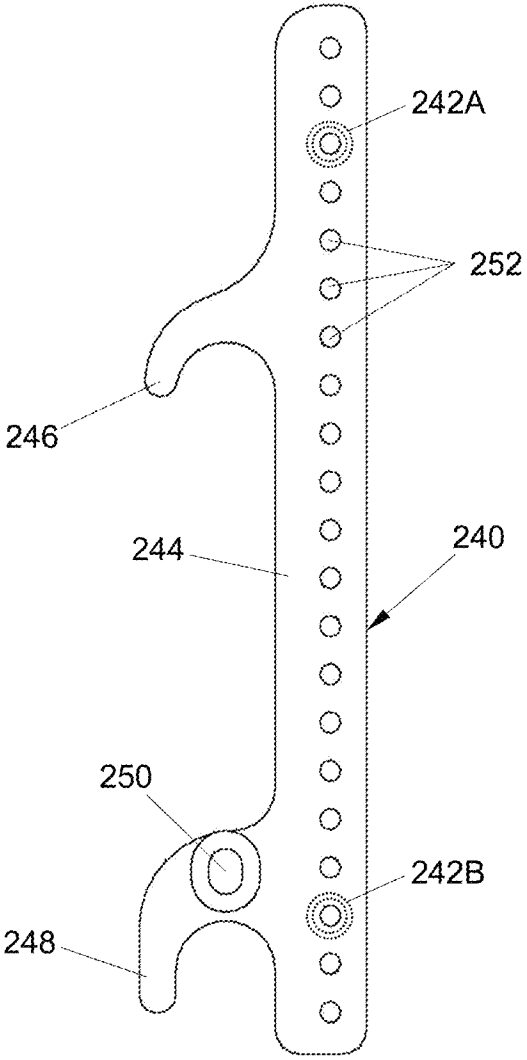
Figure 23:
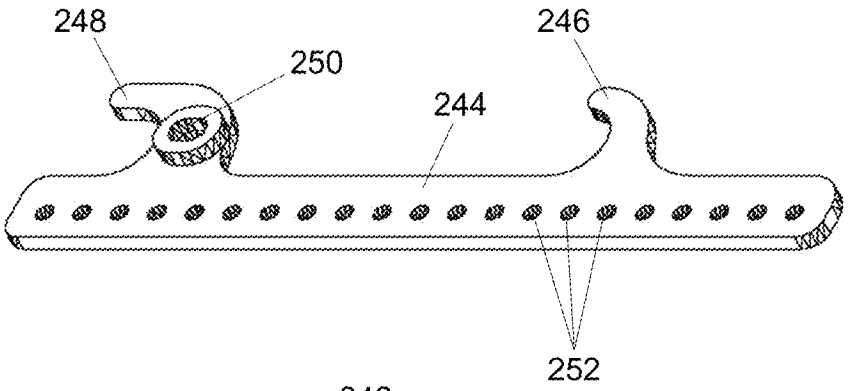
FIGS. 23 and 24 represent perspective isolated views of the attachment hooks of FIGS. 21 and 22, respectively.

FIGS. 21 and 23 represent the attachment hook 240 as comprising a pair of vertically-spaced crossbars 242A and 242B maintained in vertical alignment with respect to each other by a pair of brackets 244. Each bracket 244 has an upper hook feature 246 located at or near its uppermost extent, and a lower hook feature 248 located at or near its lowermost extent. Both upper and lower hook features 246 and 248 are C-shaped. Unlike the upper and lower hook features 46 and 48 of the attachment hook 40 and the upper and lower hook features 146 and 148 of the attachment hook 140, the upper and lower hook features 246 and 248 both define openings facing downward. With this arrangement, the attachment hook 240 can be assembled with an adapter assembly by simultaneously engaging upper and lower crossbars thereof with the upper and lower features 246 and 248, respectively. The attachment hook 240 includes an array of holes 252 to provide locations for attachment. The pair of vertically-spaced crossbars 242A and 242B are installed in respective ones of aligned pairs of these holes 252.

Figure 22:
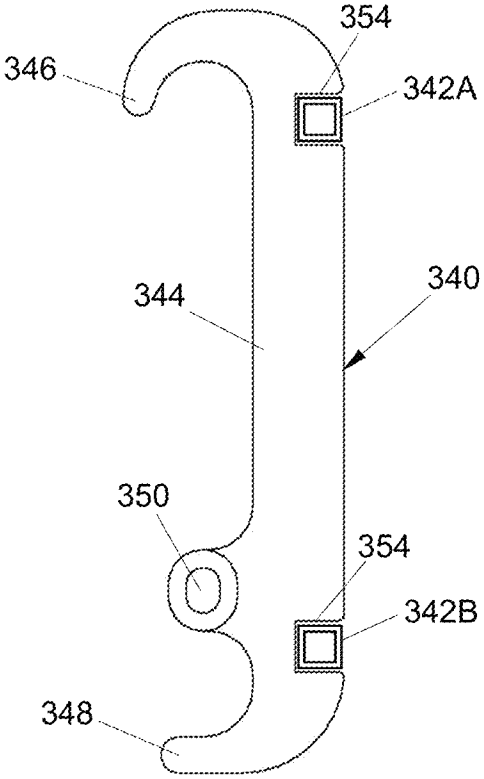
FIGS. 21 and 22 represent side views attachment hooks for use with adapter assemblies in accordance with nonlimiting embodiments of this invention.
Figure 24:
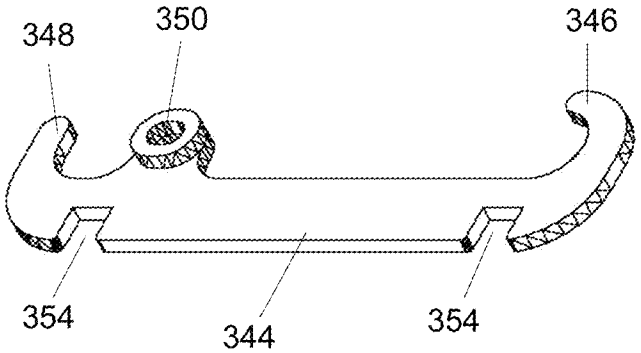

FIGS. 22 and 24 represent the attachment hook 340 as comprising a pair of vertically-spaced crossbars 342A and 342B maintained in vertical alignment with respect to each other by a pair of brackets 344. Each bracket 344 includes a pair of recesses 354 configured to receive the pair of vertically-spaced crossbars 342A and 342B.

Figure 5A:
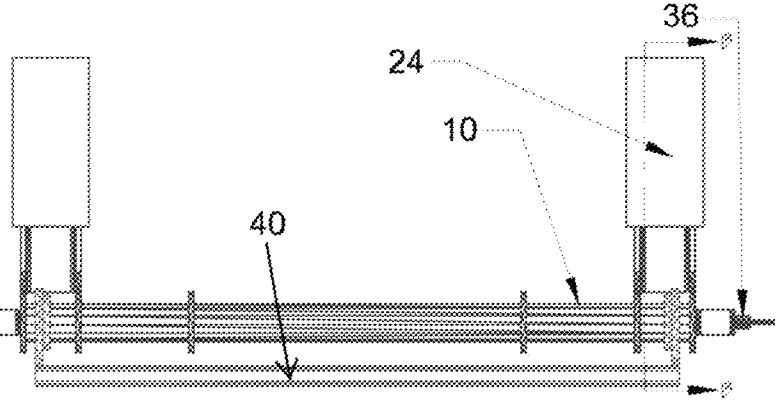
FIGS. 5A and 5B represent plan and cross-sectional views of the adapter assembly of FIGS. 1A, 1B, and 3A through 3F in accordance with the first nonlimiting embodiment of this invention.
Figure 5B:
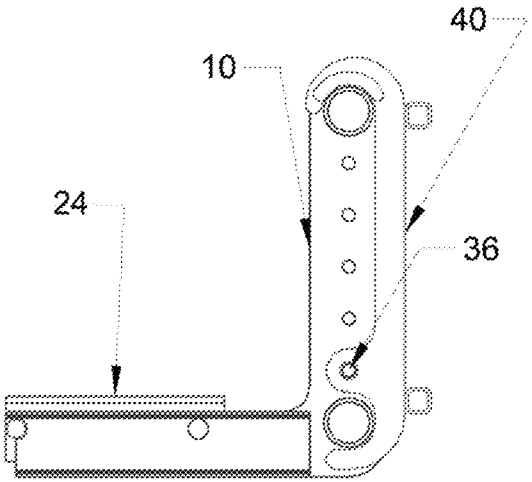
Figure 6A:
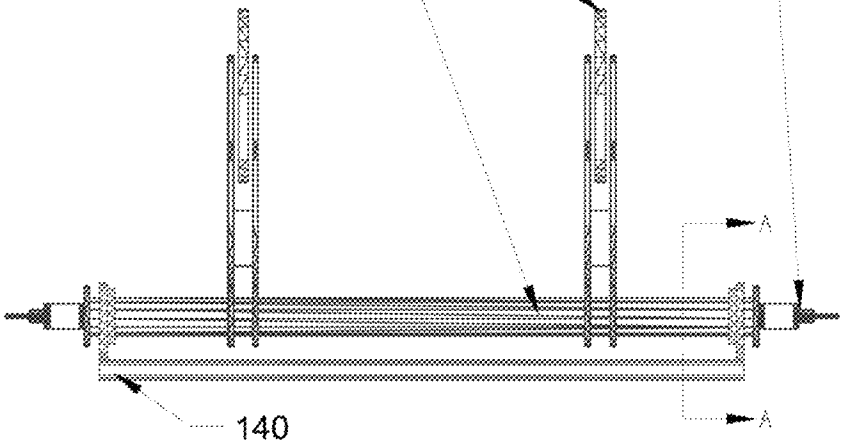
FIGS. 6A through 6D represent plan and cross-sectional views of the adapter assembly of FIGS. 2A, 2B, and 4A through 4F in accordance with the second nonlimiting embodiment of this invention.
Figure 6B:
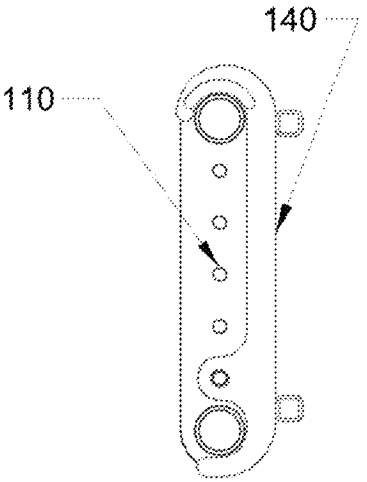
Figure 6C:
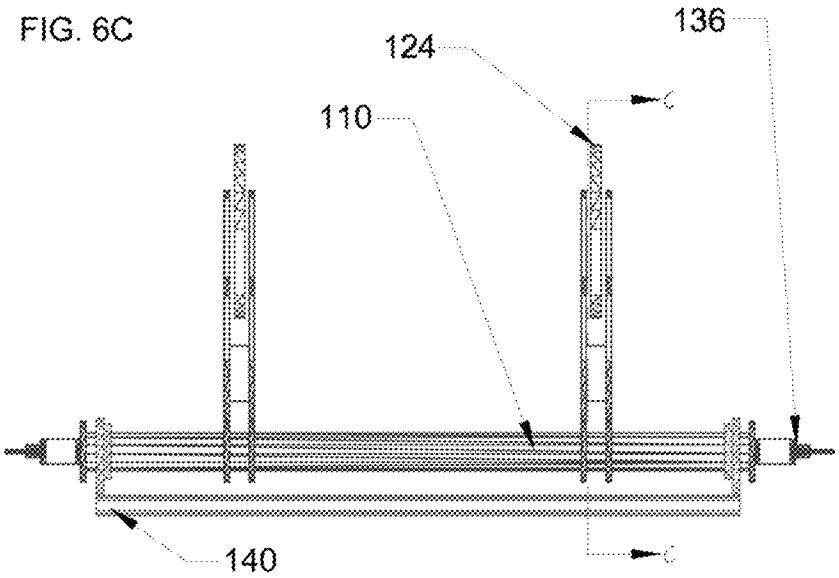
Figure 6D:
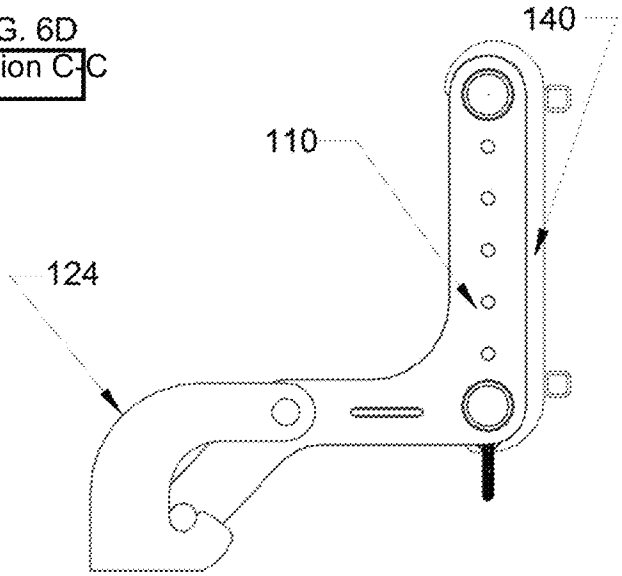

To promote the understanding of the adapter assemblies 10 and 110 and their attachment hooks 40 and 140, FIGS. 5A and 5B provide plan and cross-sectional views of the adapter assembly 10 assembled with its attachment hook 40, and FIGS. 6A through 6D provide plan and cross-sectional views of the adapter assembly 110 assembled with its attachment hook 140.

Figure 7B:
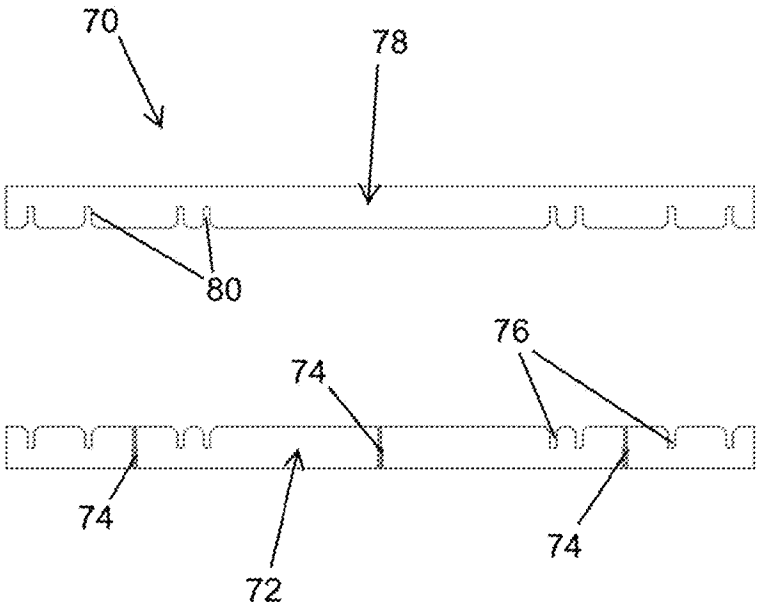
FIGS. 7A and 7B represent perspective and side views of a jig assembly for welding the adapter assemblies of FIGS. 1A through 6D in accordance with a nonlimiting embodiment of this invention.
Figure 7A:
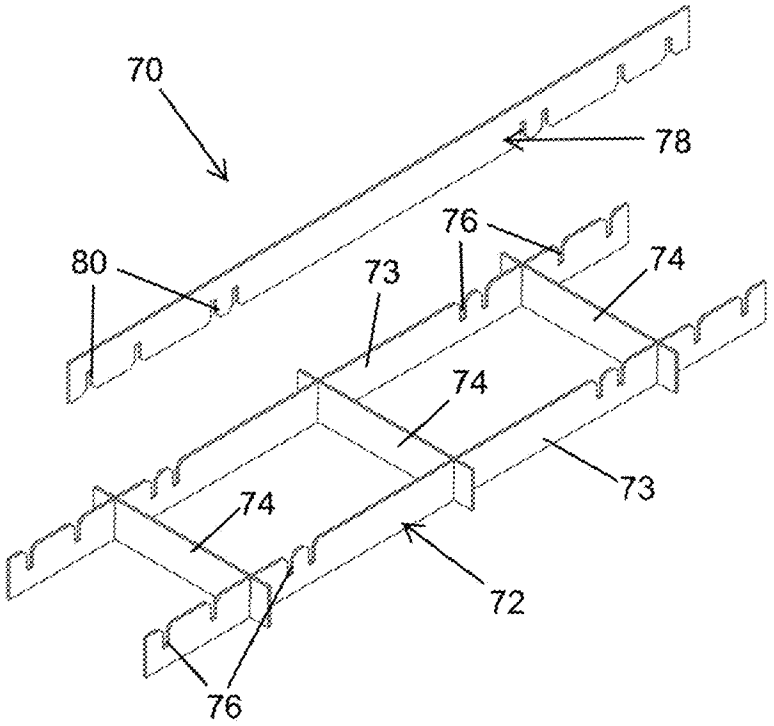
Figure 8B:
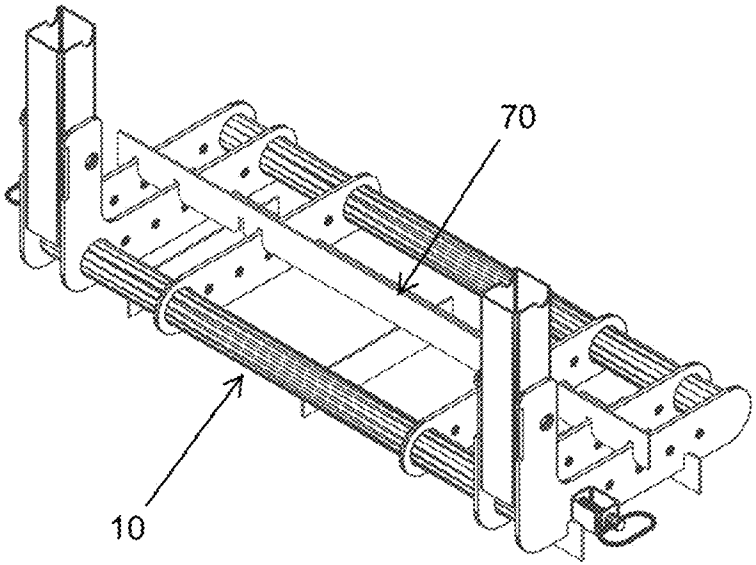
FIGS. 8A and 8B represent perspective views of components of the adapter assembly of FIGS. 1A and 3A through 3F assembled with the jig assembly of FIGS. 7A and 7B in preparation for welding.
Figure 8A:
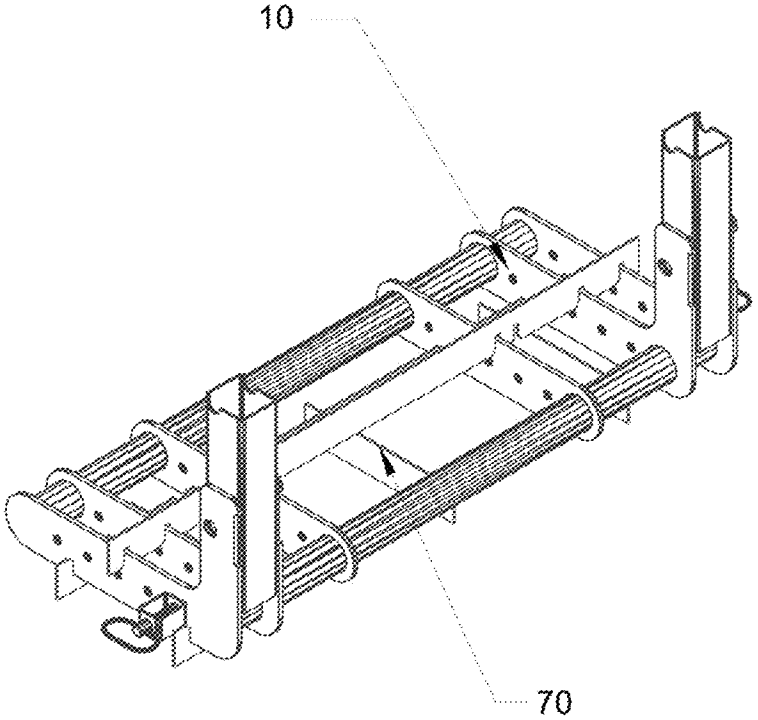
Figure 9B:
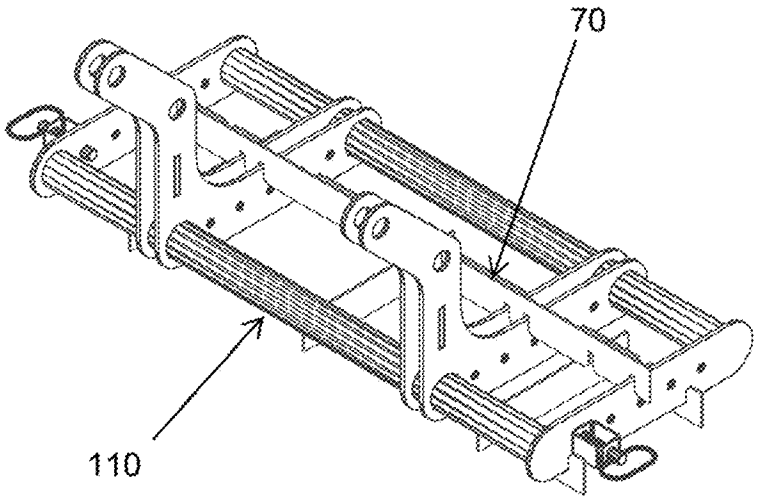
FIGS. 9A and 9B represent perspective views of components of the adapter assembly of FIGS. 2A and 4A through 4F assembled with the jig assembly of FIGS. 7A and 7B in preparation for welding.
Figure 9A:
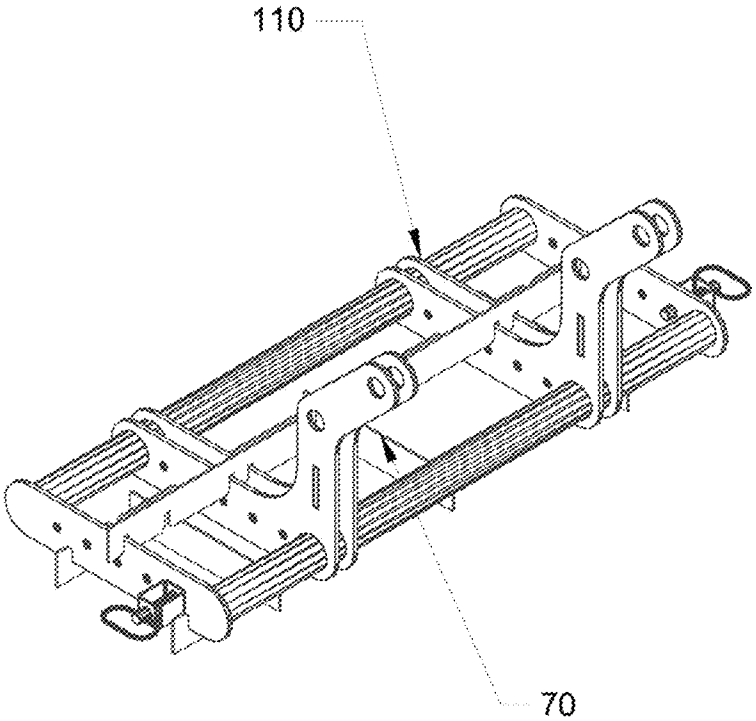

FIGS. 7A and 7B represent a jig assembly 70 configured for securing individual components of the adapter assemblies 10 and 110 during the process of joining their components, for example, by welding. The jig assembly 70 is preferably capable of being universal for adapter assemblies of the types represented in FIGS. 1A through 6D. The jig assembly 70 is represented as comprising a base unit 72 and an upper unit 78. The base unit 72 includes longitudinal members 73 interconnected with cross members 74, and slots 76 are formed in upper edges of the longitudinal members 73 that are positioned and sized to receive lower edges of the six L-shaped and spacer brackets 14, 16, and 18 of the adapter assembly 10 as shown in FIGS. 8A and 8B, as well as the six L-shaped and spacer brackets 114, 116, and 118 of the adapter assembly 110 as shown in FIGS. 9A and 9B. Though the L-shaped brackets 14 and 16 are located outboard of the spacer bracket 18 in the adapter assembly 10 and the L-shaped brackets 114 and 116 are located inboard of the spacer bracket 118 of the adapter assembly 110, the jig assembly 70 is configured to be universal as a result of locating the two sets of six brackets 14, 16, 18, 114, 116, and 118 within their respective assemblies 10 and 110 so that eight slots 76 on each member 73 are able to accommodate the positions of all six brackets of both assemblies 10 and 110, as evident from FIGS. 8A, 8B, 9A, and 9B. Similarly, the upper unit 78 of the jig assembly 70 has slots 80 formed in its lower edge that are positioned and sized to receive upper edges of the L-shaped and spacer brackets 14, 16, and 18 of the adapter assembly 10 as shown in FIGS. 8A and 8B, as well as upper edges of the L-shaped and spacer brackets 114, 116, and 118 of the adapter assembly 110 as shown in FIGS. 9A and 9B. The longitudinal members 72 are preferably spaced laterally apart by the cross members 74 so that the crossbars 12A and 12B of the adapter assembly 10 and the crossbars 112A and 112B of the adapter assembly 110 are suspended laterally from the jig assembly 70, so that the longitudinal members 72 support the entire weight of the adapter assemblies 10 and 110 during welding.

FIGS. 10 through 20 represent views of nonlimiting examples of implements and accessories that can be coupled to the adapter assemblies of the types represented in FIGS. 1A through 9B. Though the implements/accessories are shown in conjunction with the assembly 10, it should be appreciated that, due to the similarities of the attachment hooks 40 and 140, the implements/accessories shown in FIGS. 10 through 20 can be equally used in conjunction with the assembly 110.

Figure 10:
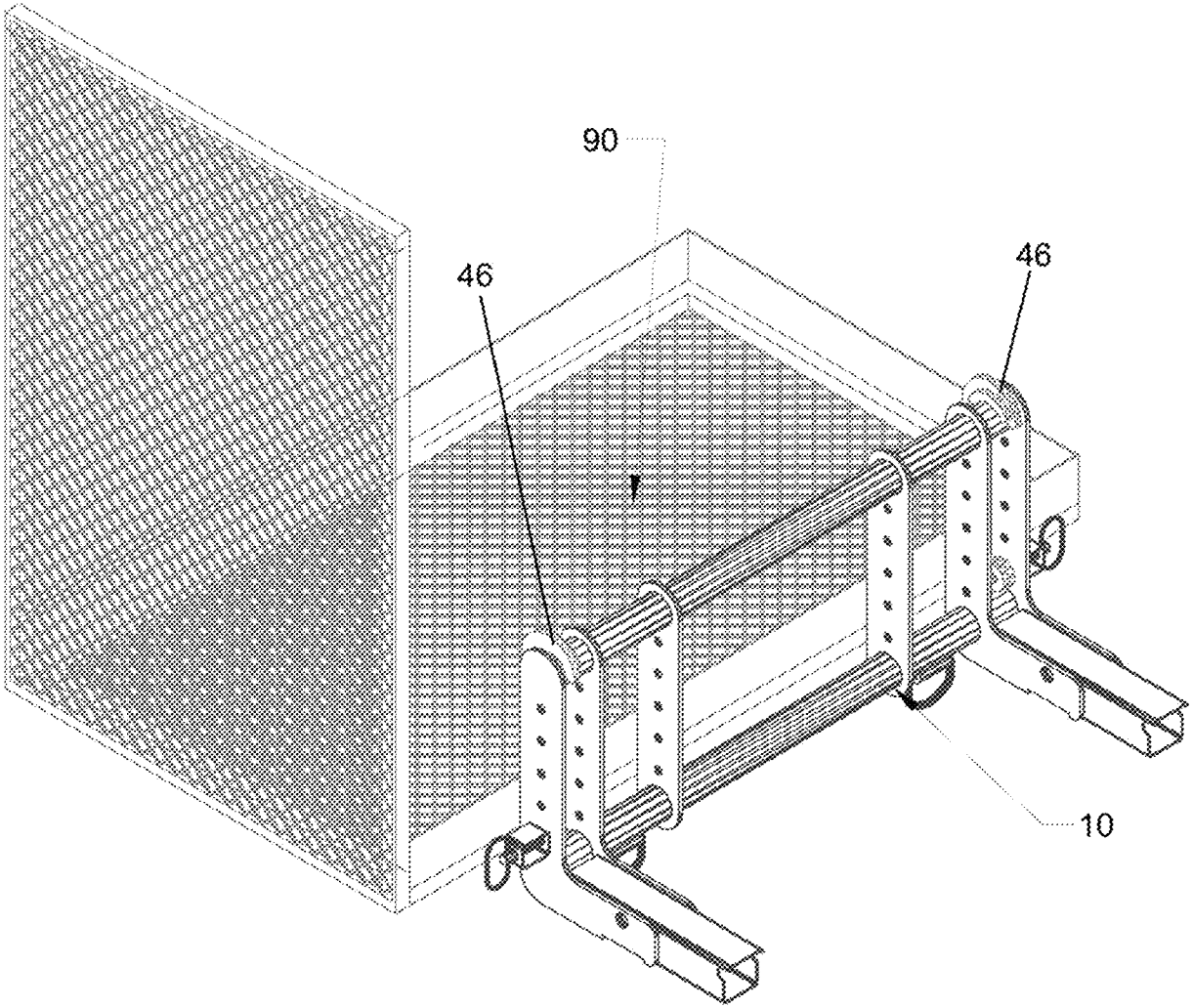
FIGS. 10 through 20 represent views of implements and accessories coupled to the adapter assembly of FIGS. 1A, 1B, and 3A through 3F in accordance with nonlimiting embodiments of the present invention.
Figure 11B:
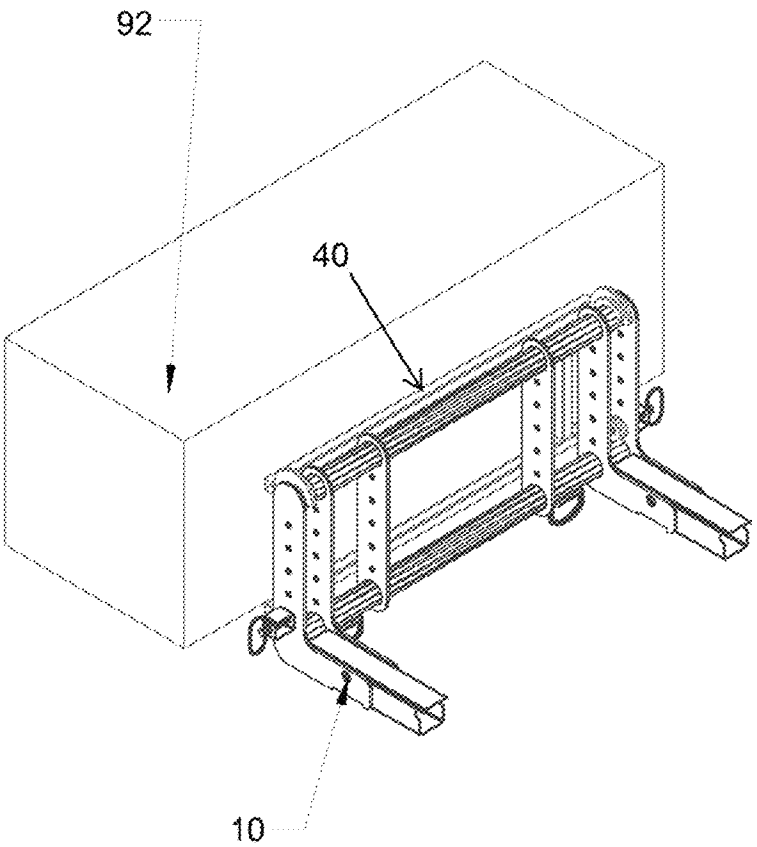
Figure 11A:
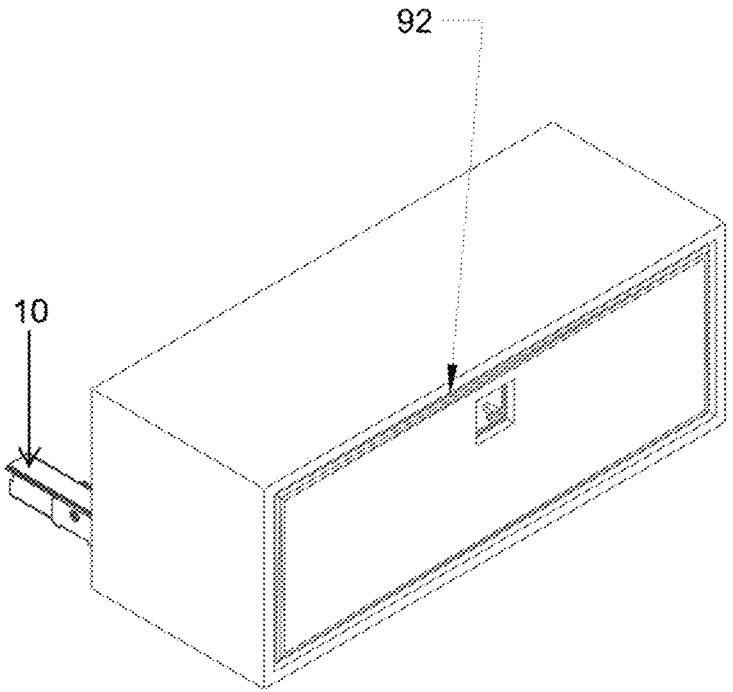
Figure 12:
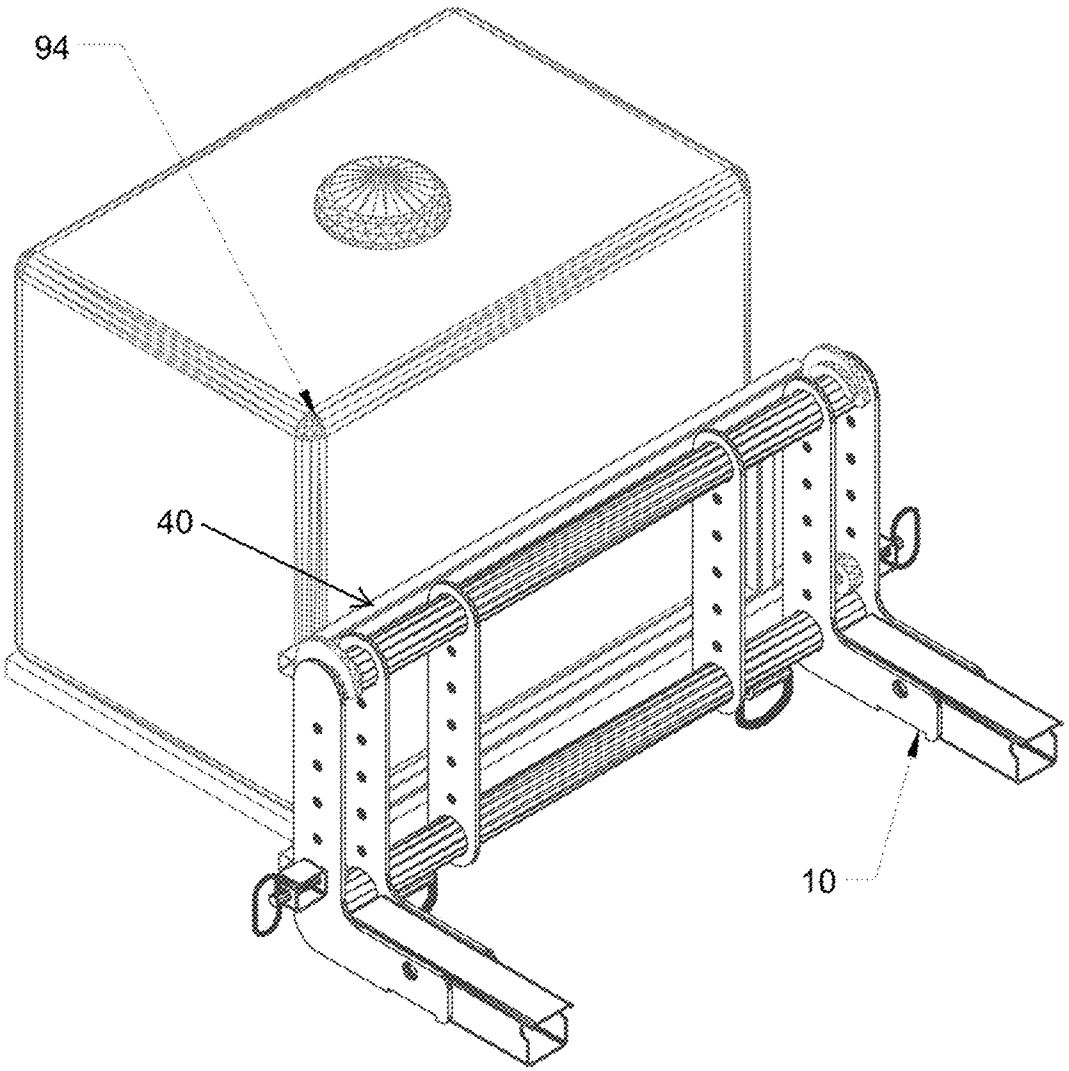
Figure 13B:
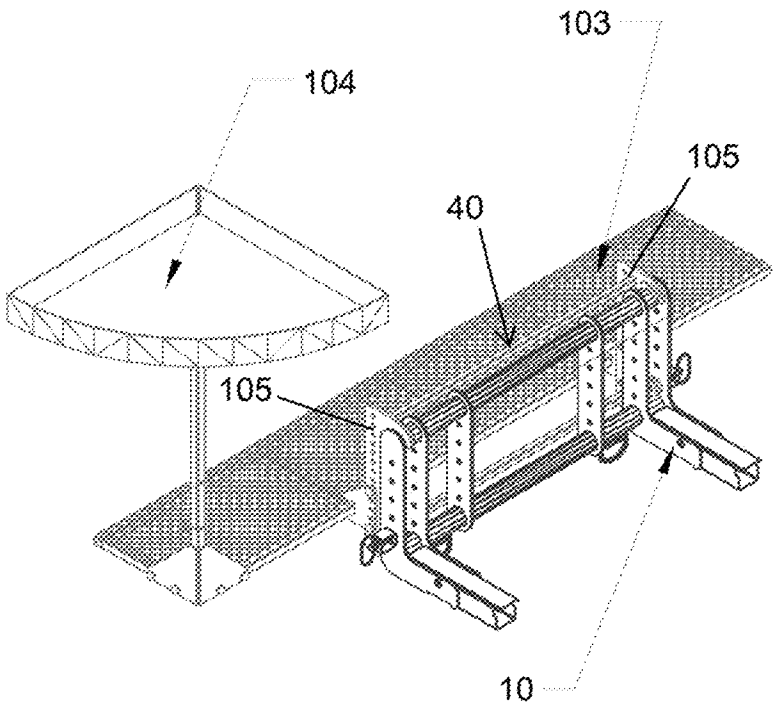
Figure 13A:
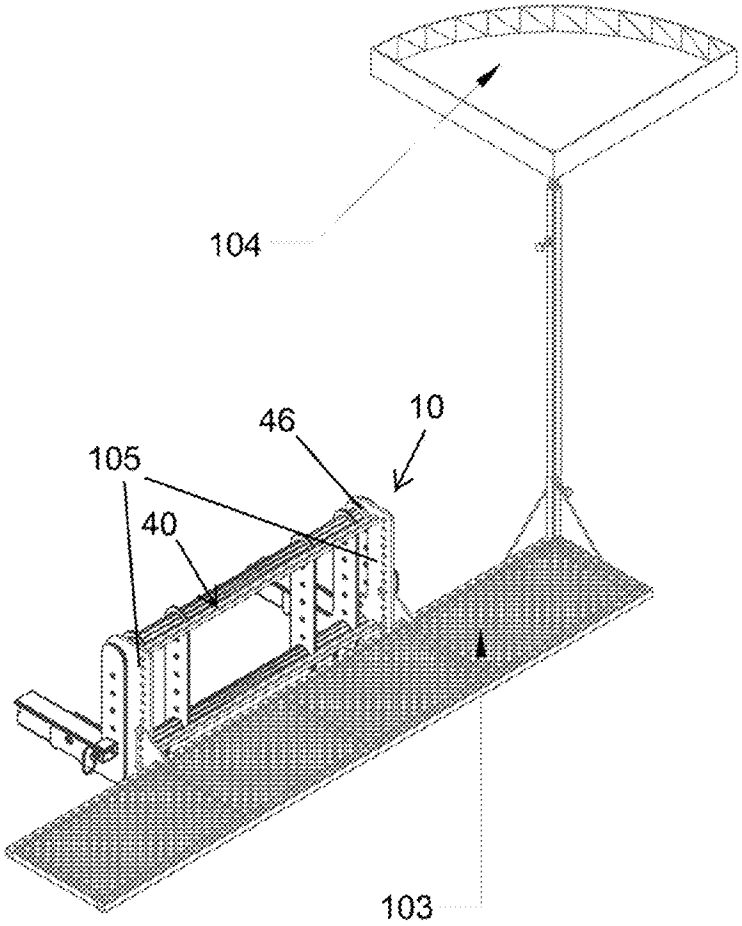

FIGS. 10, 11, 12, 13A, and 13B depict implements/accessories that can be permanently attached to the attachment hook 40 to enable each implement/accessory and its attachment hook 40 to be installed and removed from the adapter assembly 10 as a unit. FIG. 10 depicts a carrier 90 adapted for transporting small wheeled equipment and vehicles, such as a scooter. FIGS. 11A and 11B depict a toolbox 92, and FIG. 12 depicts a water tank 94. FIGS. 13A and 13B depict a service platform 103 with an adjustable tool tray 104 mounted thereto. The service platform 103 includes a pair of vertical plates 105 that are attached to the attachment hook 40.

Figure 14:
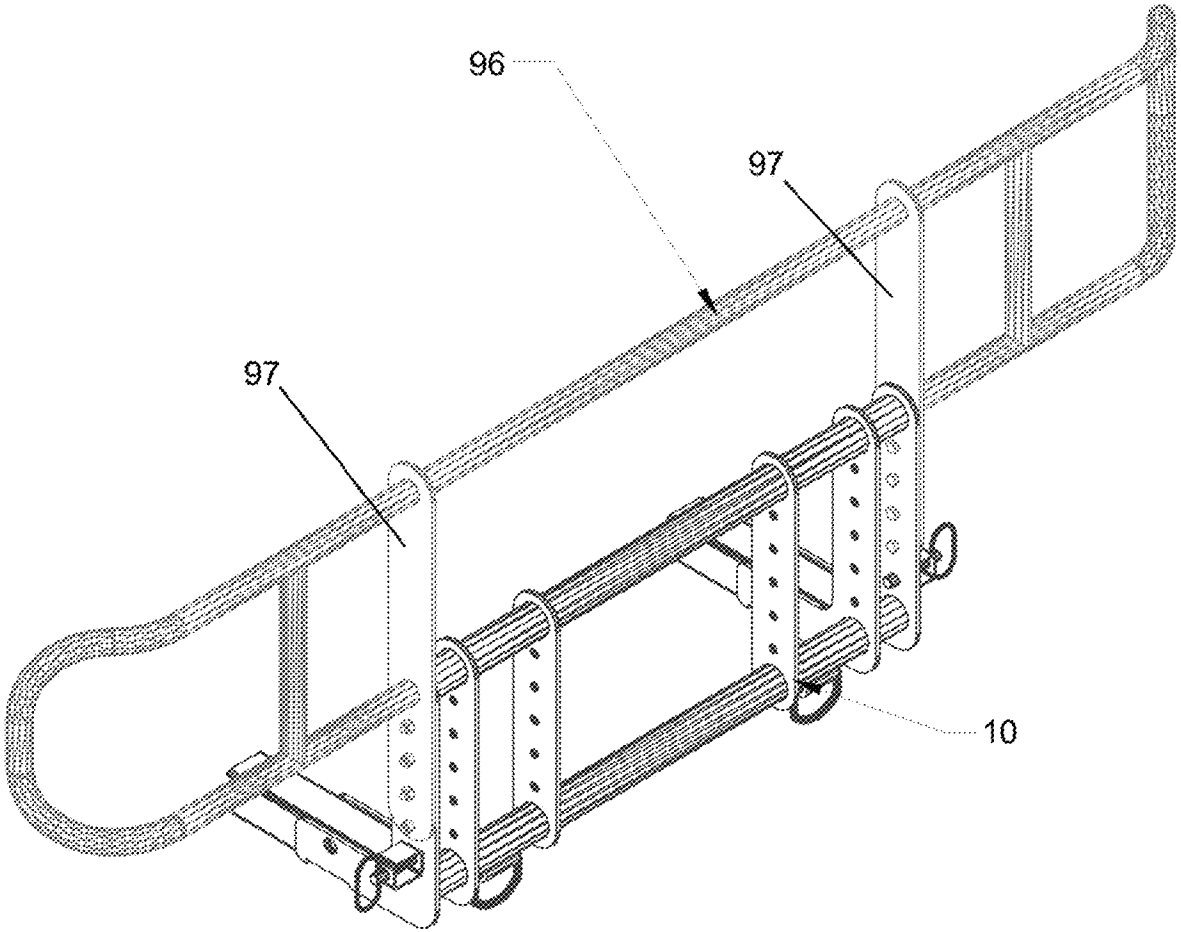
Figure 15B:
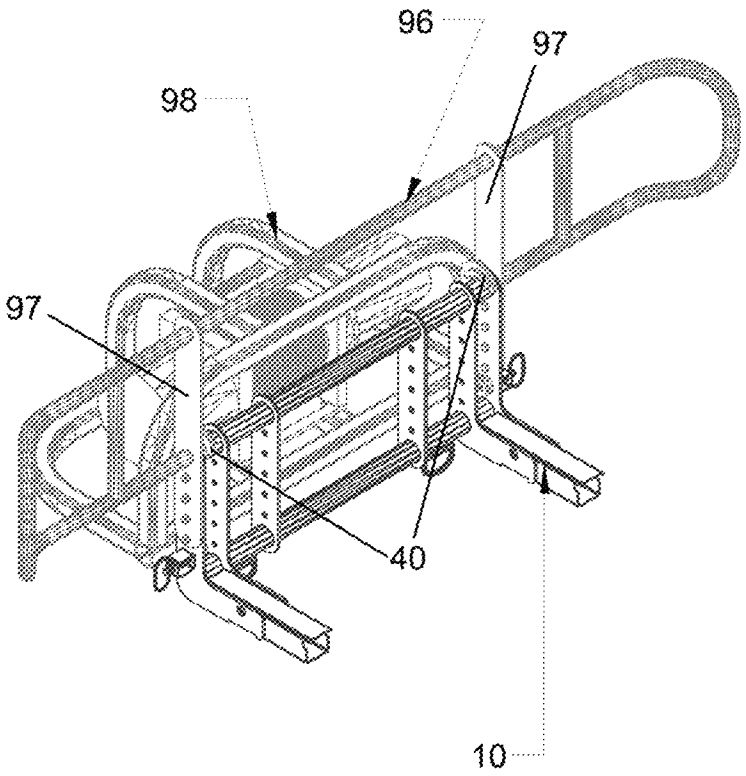
Figure 15A:
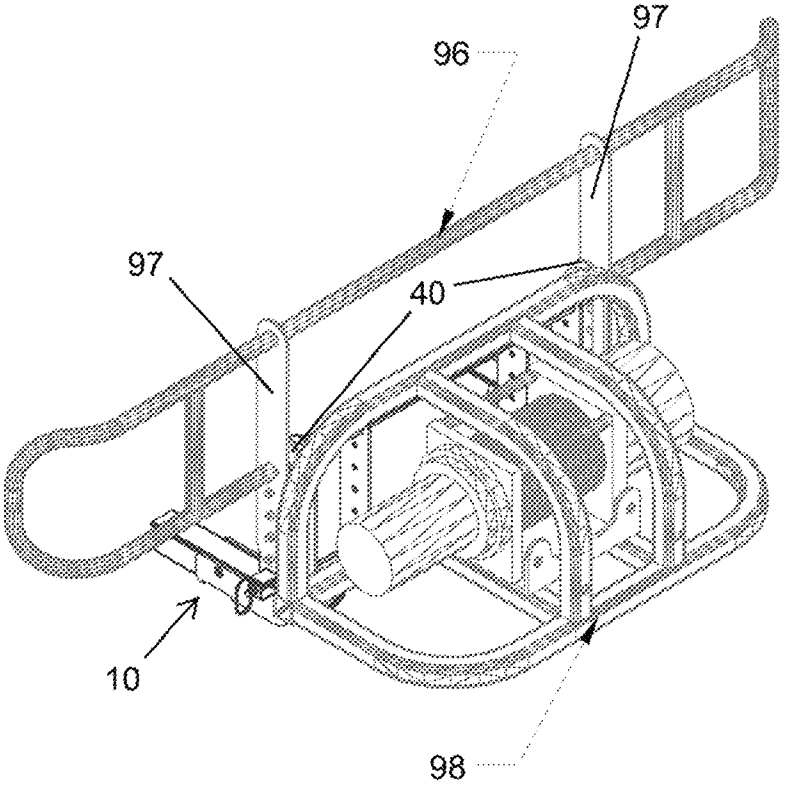
Figure 16:
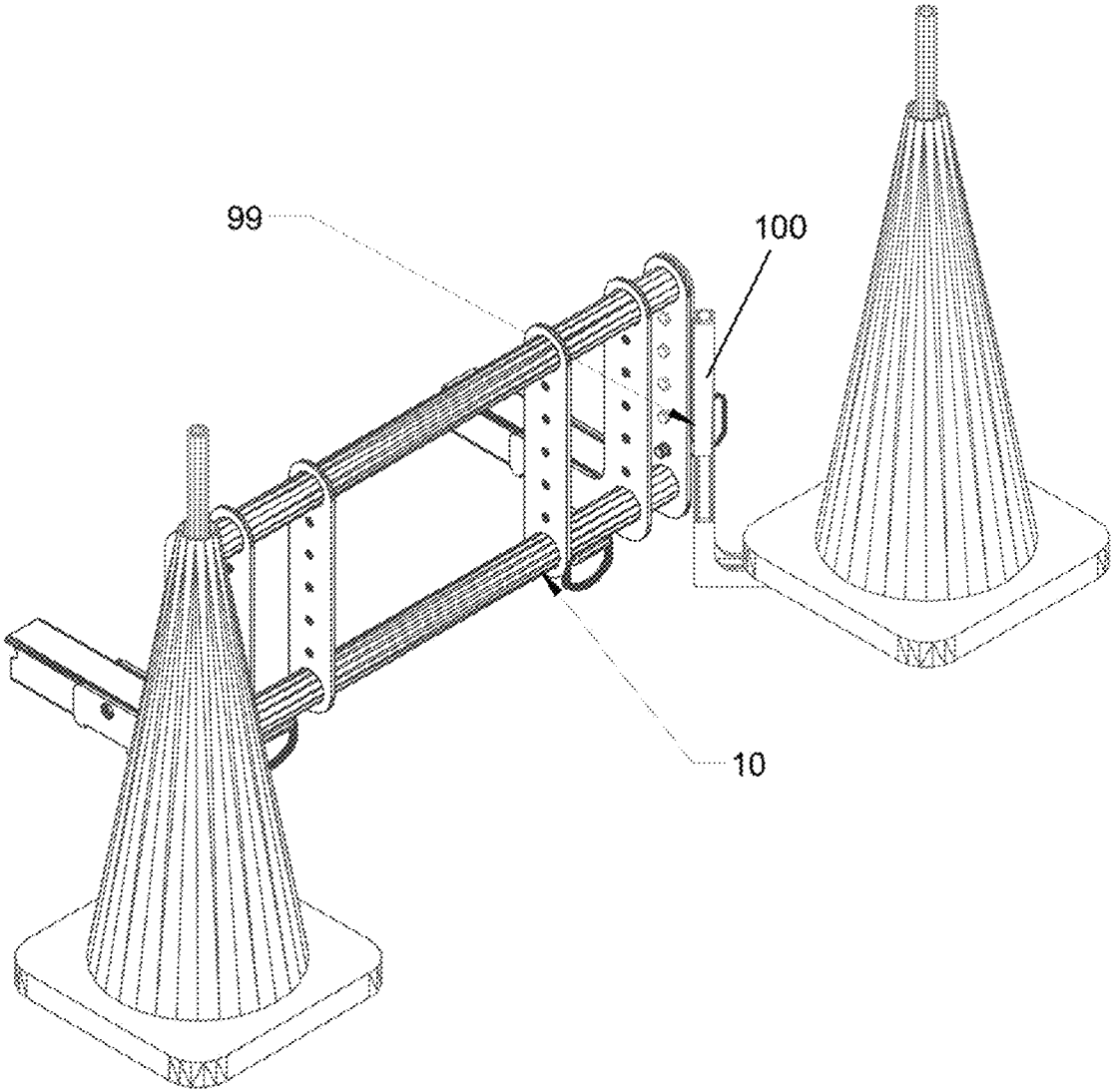
Figure 17:
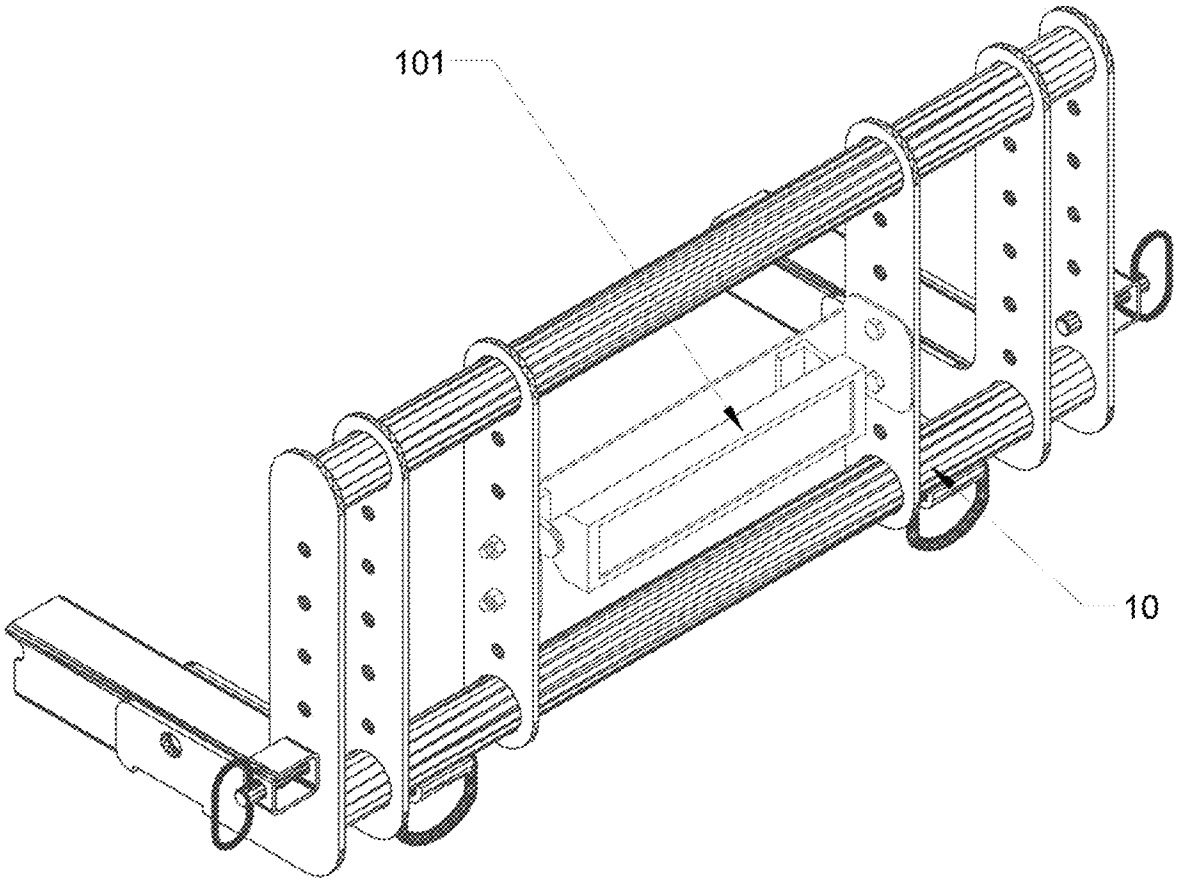
Figure 18:
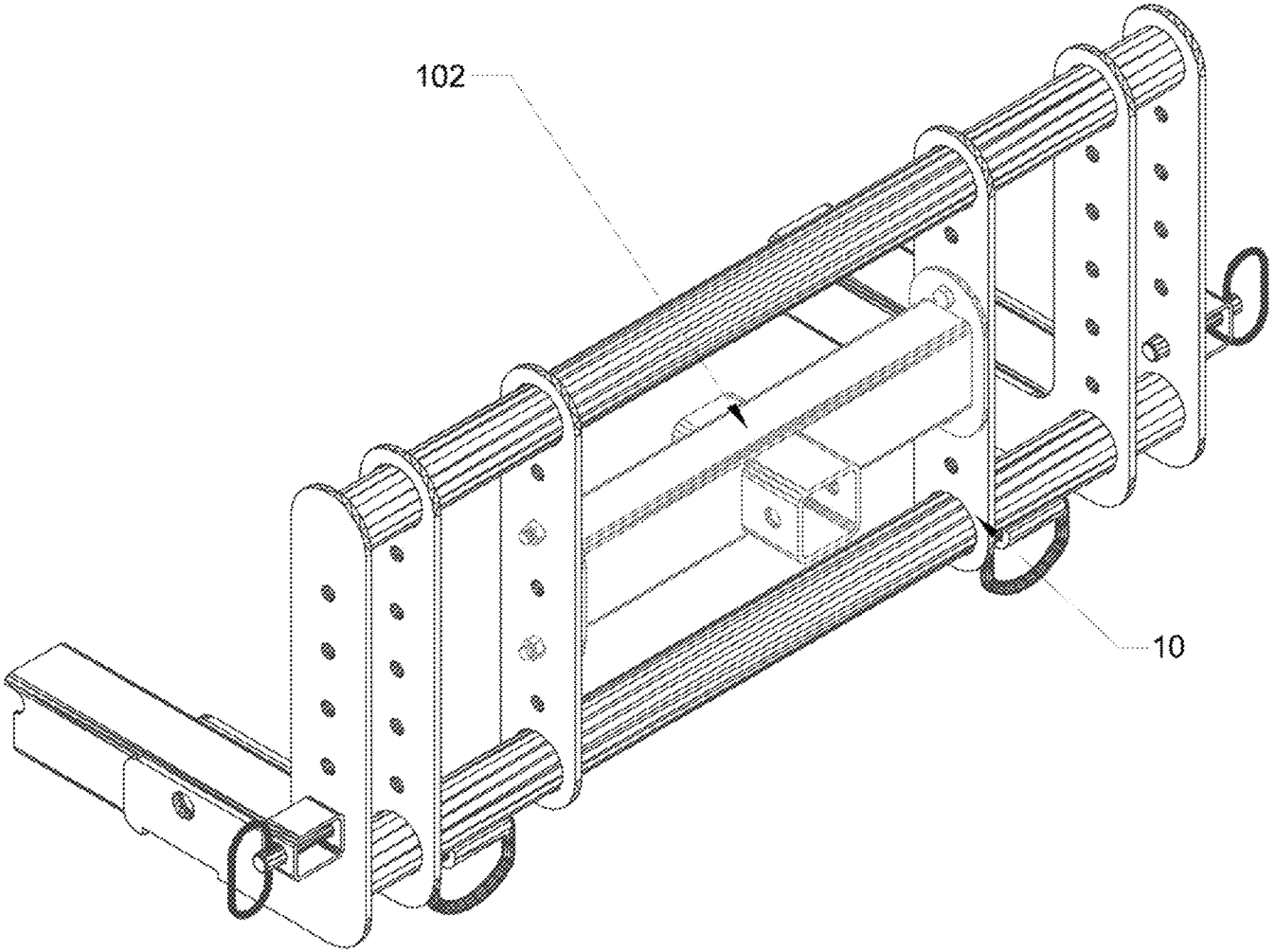
Figure 19:
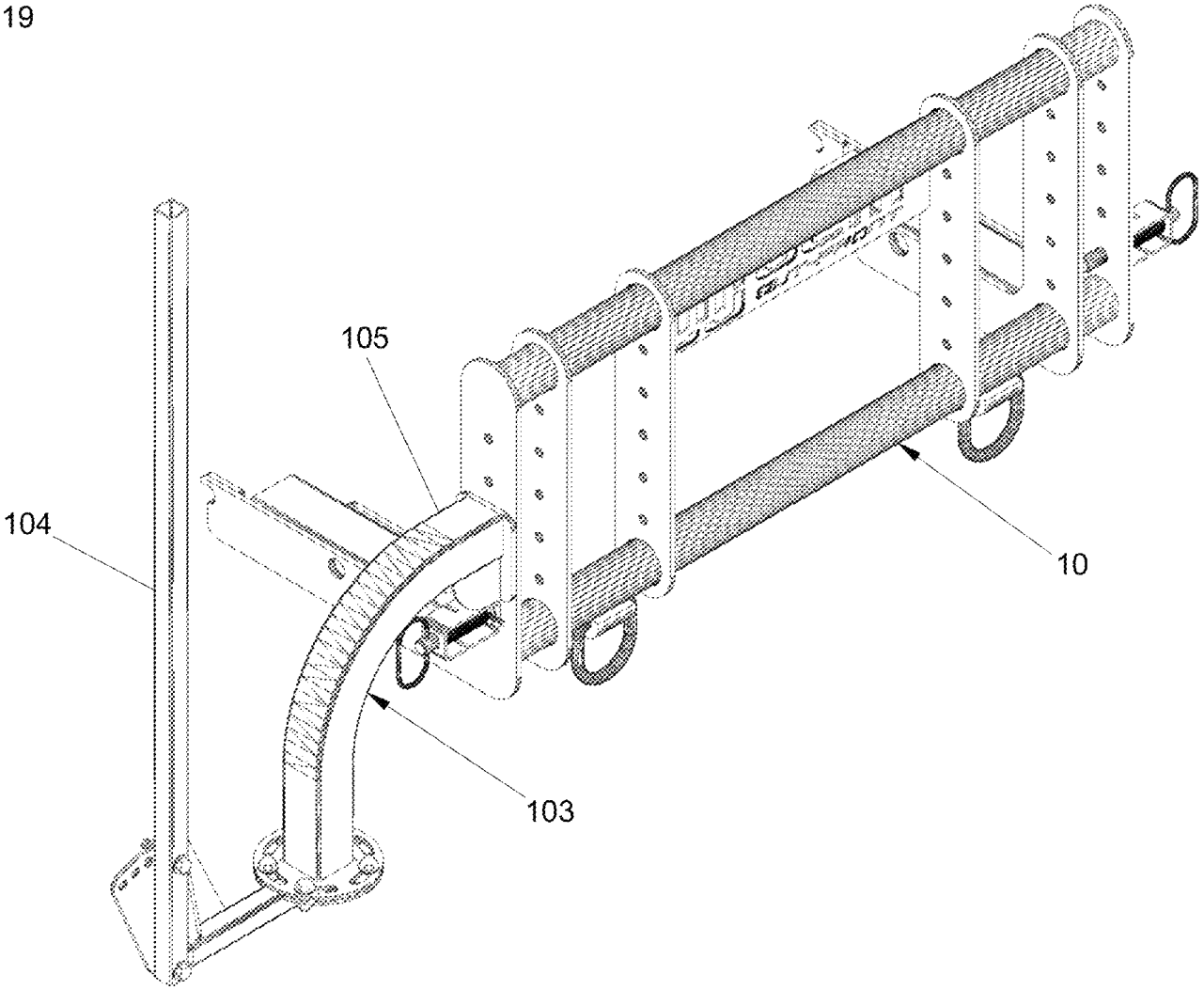
Figure 20:
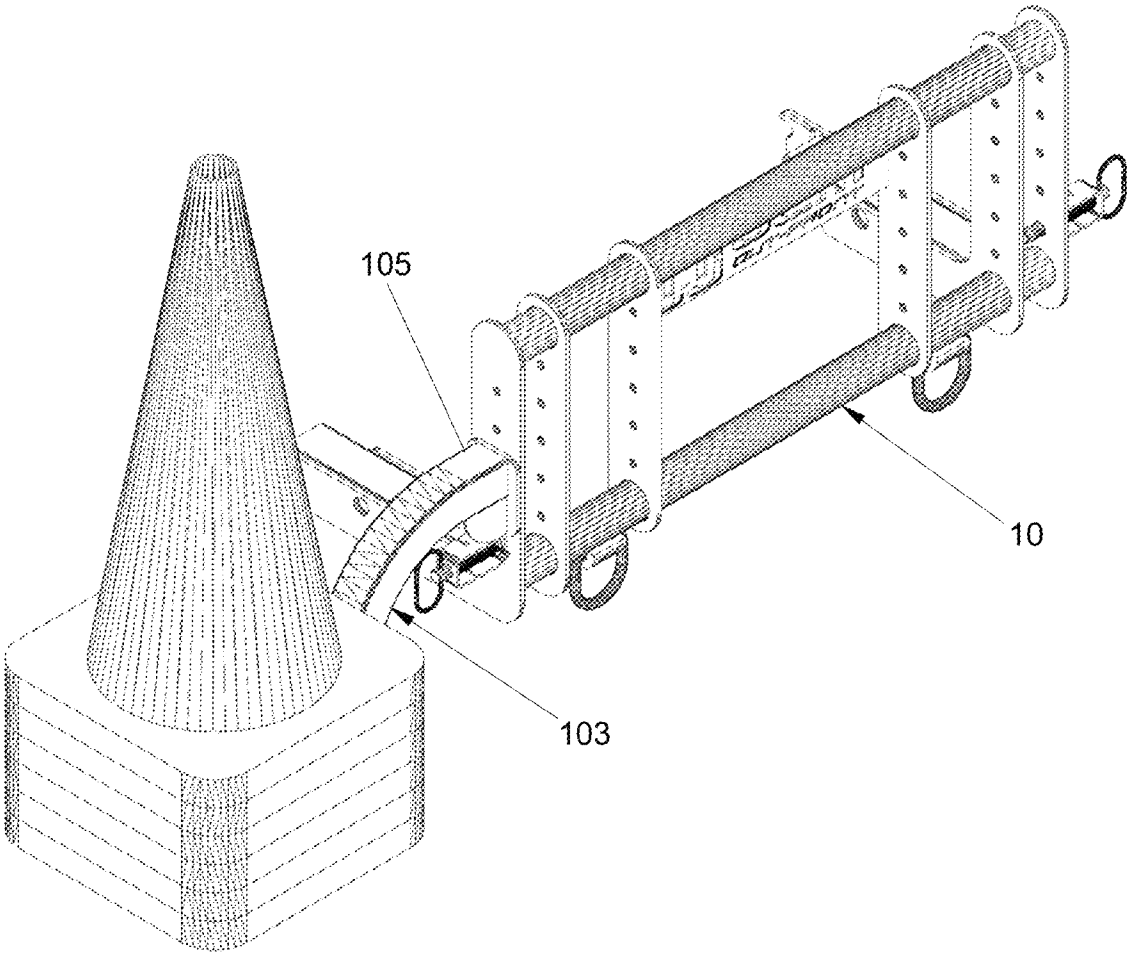

FIGS. 14 through 20 depict implements/accessories that can be attached directly to the adapter assembly 10 without the attachment hook 40. FIG. 14 depicts a grill guard 96 mounted by bolting vertical bars 97 of the guard 96 to the outboard L-shaped brackets 14 by utilizing the holes 30 preformed in the brackets 14. FIGS. 15A and 15B depict the grill guard 96 with the addition of a winch mount 98 that has been coupled to the adapter assembly 10 with the attachment hook 40. FIG. 16 depicts outboard cone carriers 99 mounted by bolting vertical bars 100 of the carriers 99 to the outboard L-shaped brackets 14 by utilizing the holes 30 preformed in the brackets 14. FIGS. 17 and 18 depict, respectively, an inboard light bar 101 and an inboard hitch receiver 102 that are similarly mounted by bolting to the spacer brackets 18 utilizing the holes 30 preformed in the brackets 18. FIGS. 19 and 20 depict outboard cone carriers 103 mounted by bolting angled bars 105 of the carriers 103 to the outboard L-shaped brackets 14 by utilizing the holes 30 preformed in the brackets 14. The carriers 103 include adjustable cone holders 104 for securing cones during transport.

Various materials can be used in the construction of the adapter assemblies 10 and 110, their attachment hooks 40 and 140, and implements and accessories mounted thereto to promote their abilities to withstand long-term outdoor exposures in harsh environments. As nonlimiting examples, suitable materials for use in the construction of the assemblies 10 and 110, attachment hooks 40 and 140, and implements and accessories include aluminum alloys and iron-based alloys including stainless steels.

As may be evident from the above description, methods for mounting an implement or accessory to a front end of a vehicle that has a mount 24 or 124 attached to a frame of the vehicle may include coupling the lower legs 20B or 120C of the pair of L-shaped brackets 14 and 16 or 114 and 116 to the mount 24 or 124 attached to the frame of the vehicle. In this position, the upper and lower crossbars 12A and 12B or 112A and 112B are horizontally oriented and spaced vertically apart from each other relative to the vehicle.

If the mount 24 comprises a C-channel, the lower legs 20B may be received in the channel 24A of the mount 24 and secured therein, for example, with the bolt 32. If the mount 24 comprises a vertically-oriented C-shaped bracket 124, the lower legs 120C may be received in the cradle 124A of the mount 124 and secured thereto. For example, at least one pin 132 that is fixed within the complementary pair of holes 138A at a lower extremity of the angular legs 120C may be received in the cradle 124A formed by its corresponding mount 124. Each lower leg unit defined by each pair of angular legs 120C may then be coupled to its mount 124 with at least one pin, bolt, or other suitable structure (not shown) that is sized to be received in the complementary pair of holes 138B at an upper extremity of the angular legs 120C and a hole 124B formed in its corresponding mount 124.

Optionally, the attachment hook 40 or 140 may be releasably coupled to the adapter assembly 10 or 110, for example, as described in relation to FIGS. 3A through 3F and 4A through 4F. In such embodiments, the upper hook feature 46 or 146 of the attachment hook 40 or 140 may be pivotally engaged to the upper crossbar 12A or 112A and the lower hook feature 48 or 148 may be engaged the lower crossbar 12B or 112B. At least one boss 50 of the attachment hook 40 or 140 may engage at least one spring-loaded lock pin 36 or 136 of the adapter assembly 10 or 110 to secure the attachment hook 40 or 140 to the adapter assembly 10 or 110.

One or more implements and/or accessories may be directly attached to one or more of the L-shaped and spacer brackets 14, 16, and 18 or 114, 116, and 118 of the adapter assembly 10 or 110 and/or directly attached to the attachment hook 40 or 140 so as to be releasably mounted to the adapter assembly 10 or 110. Such implements and/or accessories may be attached to the adapter assembly 10 or 110 and/or the attachment hook 40 or 140 prior to or after coupling the attachment hook 40 or 140 to the adapter assembly 10 or 110.

While the invention has been described in terms of specific or particular embodiments, it is apparent that other forms could be adopted by one skilled in the art. For example, the physical configuration of the assemblies 10 and its components could differ from that shown, and materials and processes/methods other than those noted could be used. Therefore, the scope of the invention is to be limited only by the following claims.

The invention claimed is:

1. An adapter assembly for mounting an implement or accessory to a front end of a vehicle that has a mount attached to a frame of the vehicle, the adapter assembly comprising:

upper and lower crossbars that are horizontally oriented and spaced vertically apart from each other, each of the upper and lower crossbars having oppositely-disposed first and second outboard ends;

a first pair of L-shaped brackets and a first spacer bracket mounted adjacent the first outboard end of each of the upper and lower crossbars and horizontally orienting and spacing the upper and lower crossbars vertically apart from each other, and a second pair of L-shaped brackets and a second spacer bracket mounted adjacent the second outboard end of each of the upper and lower crossbars and horizontally orienting and spacing the upper and lower crossbars vertically apart from each other, each of the first and second pairs of L-shaped brackets having lower legs configured to couple with the mount attached to the frame of the vehicle, each of the first and second pairs of L-shaped brackets having an upper hole receiving the upper crossbar and a lower hole receiving the lower crossbar.

2. The adapter assembly according to claim 1, wherein the first spacer bracket is located closer to the first outboard ends of the upper and lower crossbars than the first pair of L-shaped brackets, and the second spacer bracket is located closer to the second outboard ends of the upper and lower crossbars than the second pair of L-shaped brackets.

3. The adapter assembly according to claim 2, wherein the mount comprises a vertically-oriented C-shaped bracket and the lower legs are configured to be received in a cradle of the mount.

4. The adapter assembly according to claim 1, wherein the adapter assembly has an attachment hook releasably coupled thereto.

5. The adapter assembly according to claim 4, wherein the attachment hook comprises an upper hook feature adapted to pivotally engage the upper crossbar and a lower hook feature adapted to engage the lower crossbar.

6. The adapter assembly according to claim 4, wherein the attachment hook comprises at least a first boss and the adapter assembly comprises at least one spring-loaded lock pin for engaging the first boss to secure the attachment hook to the adapter assembly.

7. The adapter assembly according to claim 6, wherein the lower legs of each of the first and second pairs of L-shaped brackets include a mounting bar therebetween.

8. The adapter assembly according to claim 4, further comprising an implement or accessory directly attached to the attachment hook so as to be releasably mountable to the adapter assembly.

9. The adapter assembly according to claim 1, further comprising an implement or accessory directly attached to one or more of the first and second pairs of L-shaped brackets and the first and second spacer brackets of the adapter assembly.

10. The adapter assembly according to claim 1, wherein the vehicle is a passenger vehicle.

11. The adapter assembly according to claim 10, wherein the passenger vehicle is a truck, an ATV, or a UTV.

12. The adapter assembly according to claim 1, wherein the mount is a snowplow mount.

13. A method for mounting an implement or accessory to a front end of a vehicle that has a mount attached to a frame of the vehicle, the method comprising:

providing an adapter assembly that includes upper and lower crossbars, first and second pairs of L-shaped brackets, and first and second spacer brackets, the upper and lower crossbars being horizontally oriented and spaced vertically apart from each other, each of the upper and lower crossbars having oppositely-disposed first and second outboard ends, the first pair of L-shaped brackets and the first spacer bracket being mounted adjacent the first outboard end of each of the upper and lower crossbars and horizontally orienting and spacing the upper and lower crossbars vertically apart from each other, and the second pair of L-shaped brackets and the second spacer bracket being mounted adjacent the second outboard end of each of the upper and lower crossbars and horizontally orienting and spacing the upper and lower crossbars vertically apart from each other, each of the first and second pairs of L-shaped brackets having an upper hole receiving the upper crossbar and a lower hole receiving the lower crossbar;

coupling lower legs of the first and second pairs of L-shaped brackets to the mount attached to the frame of the vehicle; and attaching an implement or accessory to the adapter assembly.

14. The method according to claim 13, wherein the mount comprises a C-channel and the lower legs are received in a channel of the mount.

15. The method according to claim 13, wherein the mount comprises a vertically-oriented C-shaped bracket and the lower legs are received in a cradle of the mount.

16. The method according to claim 13, further comprising releasably coupling an attachment hook to the adapter assembly.

17. The method according to claim 16, further comprising directly attaching the implement or accessory to the attachment hook so as to be releasably mountable to the adapter assembly.

18. The method according to claim 13, wherein the implement or accessory is directly attached to one or more of the first pair or second pair of L-shaped brackets and the first pair or second spacer brackets of the adapter assembly.

* * * * *